US009207591B2

(12) United States Patent
Matsumoto et al.

(10) Patent No.: US 9,207,591 B2
(45) Date of Patent: Dec. 8, 2015

(54) FIXING DEVICE AND IMAGE FORMING APPARATUS

(71) Applicant: CANON KABUSHIKI KAISHA, Tokyo (JP)

(72) Inventors: Yasuaki Matsumoto, Susono (JP); Hironobu Ata, Mishima (JP); Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/083,743

(22) Filed: Nov. 19, 2013

(65) Prior Publication Data

US 2014/0140720 A1 May 22, 2014

(30) Foreign Application Priority Data

Nov. 21, 2012 (JP) ..... 2012-255370
Nov. 13, 2013 (JP) ..... 2013-234942

(51) Int. Cl.
*G03G 15/20* (2006.01)

(52) U.S. Cl.
CPC ..... *G03G 15/2025* (2013.01); *G03G 15/2078* (2013.01)

(58) Field of Classification Search
CPC ..... G03G 15/2025; G03G 15/2078
USPC ..... 399/98, 328
See application file for complete search history.

(56) References Cited

U.S. PATENT DOCUMENTS

2004/0258427 A1* 12/2004 Takahashi ..... 399/69
2008/0181645 A1* 7/2008 Nakamura ..... 399/70
2011/0222881 A1* 9/2011 Yamada ..... 399/329
2011/0243598 A1* 10/2011 Suzuki ..... 399/98

FOREIGN PATENT DOCUMENTS

JP 2010-249874 A 11/2010

* cited by examiner

*Primary Examiner* — Ryan Walsh
(74) *Attorney, Agent, or Firm* — Canon USA Inc. IP Division

(57) ABSTRACT

A fixing device includes a rotatable fixing member configured to heat and fix, onto a recording material, a toner image formed on the recording material, a restriction member configured to restrict movement of the rotatable fixing member in a generatrix direction of the rotatable fixing member, and a capture member configured to capture a component vaporized by heat. The capture member is arranged to face a curved surface portion of the rotatable fixing member and is positioned by the restriction member.

21 Claims, 33 Drawing Sheets

SIDE VIEW

SECTIONAL VIEW

SIDE VIEW

SECTIONAL VIEW

SIDE VIEW

SECTIONAL VIEW

SIDE VIEW

SECTIONAL VIEW

FIXING DEVICE AND IMAGE FORMING APPARATUS

BACKGROUND OF THE INVENTION

1. Field of the Invention

The present invention relates to a fixing device that heats and fixes, onto a recording material, a toner image formed on the recording material and to an image forming apparatus that uses an electrophotography recording technique, such as a copying machine or a printer including the fixing device.

2. Description of the Related Art

Electrophotographic image forming apparatuses include a fixing device that fixes a toner image formed on a recording material. Generally, a contact-type fixing device including a roller or a belt is used, and a toner image is heated and fixed by bringing the roller or the belt into contact with the toner image.

With such contact-type fixing device, a phenomenon called toner offset is inevitably caused. Toner offset is a phenomenon where part of a toner image on a recording material adheres to the roller or the belt and the part of the toner image is removed from the recording material as a result. In one method for preventing such toner offset, toner containing a wax component made of a hydrocarbon compound is used.

If such toner including wax is used, the wax is liquefied by heating performed when the toner image is fixed. Part of the liquefied wax could be vaporized. The vaporized component is solidified immediately after vaporization and floats inside the device. If the temperature inside the device rises as the device operates, the floating component (hereinafter referred to as wax component) is liquefied and adheres to various parts inside the device. If the wax component adheres to a conveyance guide, the wax component hinders movement of a recording material. If the wax component adheres to a conveyance roller, the friction coefficient of the roller is decreased. In either case, performance in conveying a recording material is decreased. In addition, a recording material could be jammed by these phenomena.

Recently, there has been a growing demand for image forming apparatuses that operate at a higher speed. Forming images at a higher speed while satisfying fixability of toner requires more energy than ever. Thus, it is necessary to ensure energy given to a toner image on a recording material, for example, by increasing the width of the fixing nip portion in the fixing device or by increasing the control temperature of the fixing device. However, as a result of such increase, the amount of the component vaporized from the wax is increased, and various problems are easily caused by the above adhesion of the wax component.

Japanese Patent Application Laid-Open No. 2010-249874 discusses arranging a capture member for capturing the wax component on the inside of a frame of a fixing device.

To capture the wax component, it is desirable that the temperature of the capture member be set so that the wax component remains in a liquid state. If the temperature of the capture member is too low, since the floating wax component is solid substance, the wax component is slid on the capture member. Namely, the wax component is not adsorbed on the capture member. If the temperature of the capture member is too high, the wax component adsorbed on the capture member is vaporized again. Thus, to effectively capture the vaporized component, it is important to maintain the temperature of the capture member within an appropriate temperature range. A device capable of setting the temperature of the capture member at a more appropriate temperature than the device discussed in Japanese Patent Application Laid-Open No. 2010-249874 is demanded.

SUMMARY OF THE INVENTION

According to an aspect of the present invention, a fixing device includes a rotatable fixing member configured to heat and fix, onto a recording material, a toner image formed on the recording material, a restriction member configured to restrict movement of the rotatable fixing member in a generatrix direction of the rotatable fixing member, and a capture member configured to capture a component vaporized by heat. The capture member is arranged to face a curved surface portion of the rotatable fixing member and is positioned by the restriction member.

According to another aspect of the present invention, an image forming apparatus includes a fixing unit configured to heat and fix, onto a recording material, a toner image formed on the recording material. The fixing unit includes a rotatable fixing member and a capture member configured to capture a component vaporized by heat. The capture member is movable so that a distance between the rotatable fixing member and the capture member changes according to a sheet-passing condition of the recording material.

According to yet another aspect of the present invention, a fixing device includes a rotatable fixing member configured to heat and fix, onto a recording material, a toner image formed on the recording material and a capture member configured to capture a component vaporized by heat. The capture member moves according to information relating to a temperature of the capture member.

Further features of the present invention will become apparent from the following description of exemplary embodiments with reference to the attached drawings.

DESCRIPTION OF THE EMBODIMENTS

Figure 1:
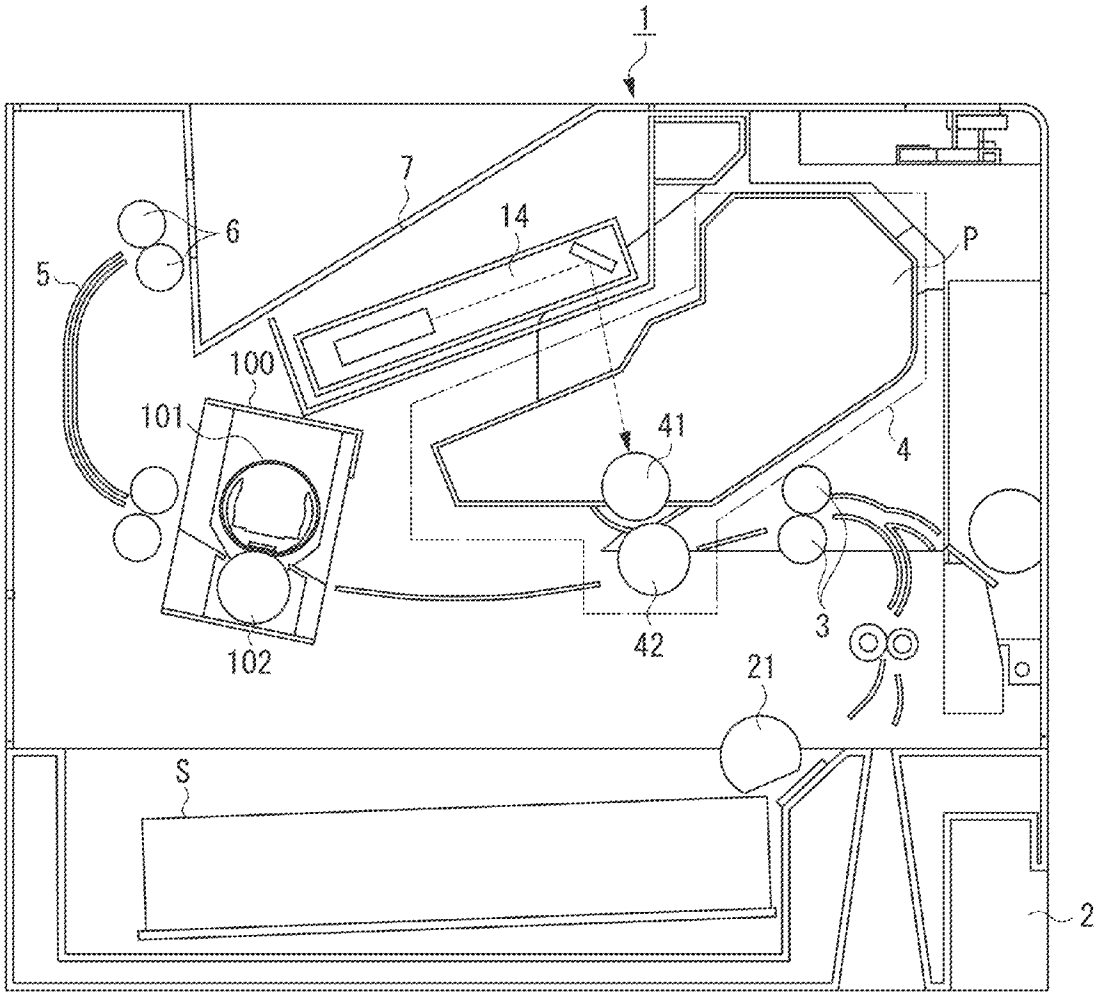
FIG. 1 is a sectional view illustrating an overall configuration of an image forming apparatus.
Figure 2:
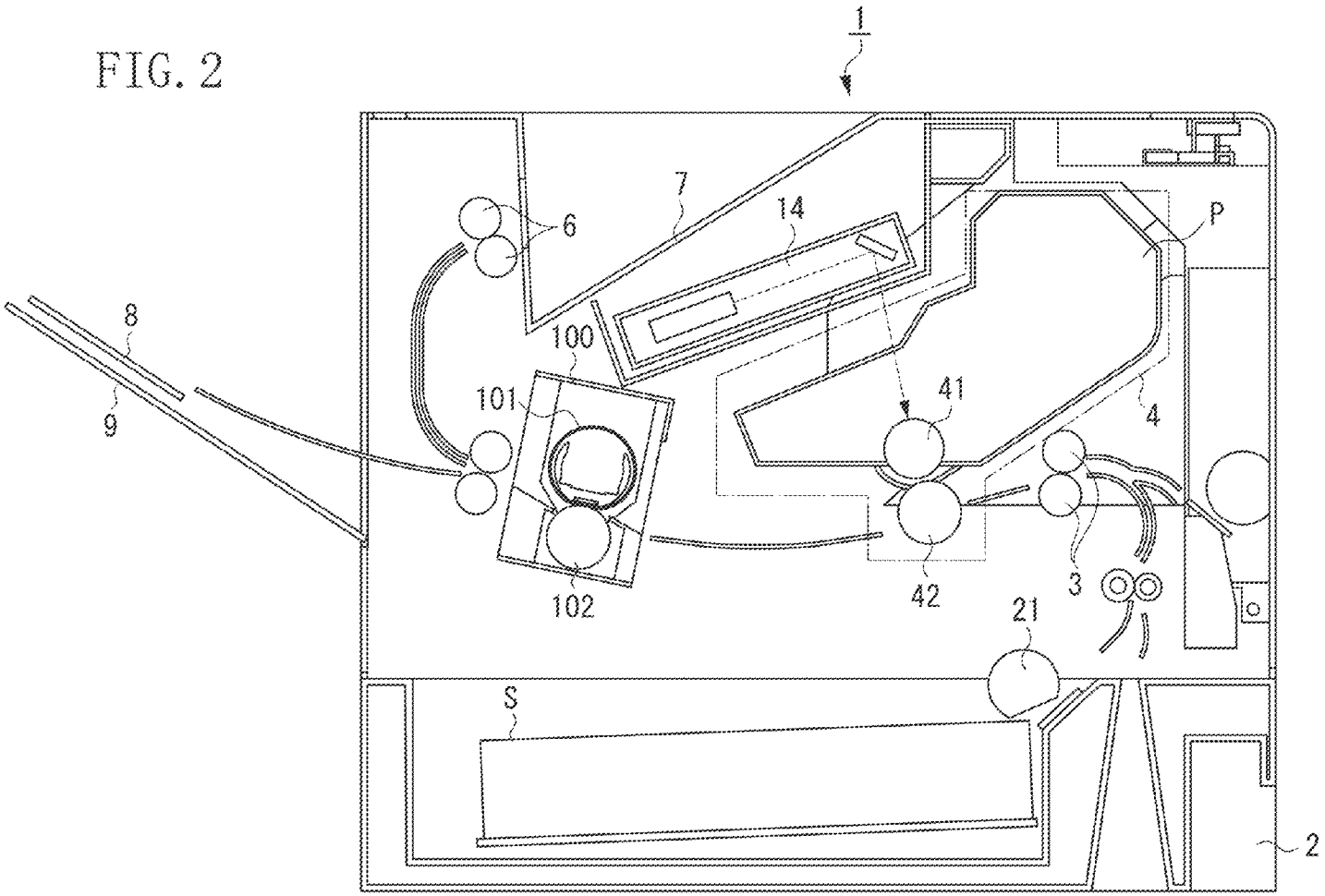
FIG. 2 illustrates an operation for discharging a sheet onto a face-up tray.

FIGS. 1 and 2 are schematic sectional views illustrating an overall configuration of an image forming apparatus 1. The image forming apparatus 1 uses an electrophotography recording technique to form an image. More specifically, in the image forming apparatus 1, first, a sheet (recording material) S is conveyed to an image forming unit and a toner image is transferred onto the sheet S. Next, the sheet S is conveyed to a fixing unit to fix the toner image and the sheet S is discharged to a discharging unit.

A cassette 2 installed in the bottom part of the image forming apparatus 1 stores a stack of sheets S. A feed roller 21 feeds the sheets S sequentially from a topmost sheet S, and a conveyance roller pair 3 conveys the sheet S to the image forming unit. The image forming unit includes photosensitive drums 41, a laser scanner 14 forming images on the respective photosensitive drums 41, and a transfer roller 42 transferring the toner images formed on the respective photosensitive drums 41 onto the recording material. Since these configurations are known, detailed description thereof will be omitted. The photosensitive drums 41 and process units that act on the photosensitive drums 41 are integrated in a cartridge P in FIG. 1. The toner used contains a release wax component made of a hydrocarbon compound, as offset measures.

The sheet S on which an unfixed toner image is formed is conveyed to a fixing device (fixing unit) 100. The fixing unit 100 includes a heating unit 101 including a fixing film (a rotatable fixing member) 105 and a ceramic heater 103 that is arranged in the tube of the fixing film 105 and that serves as a heat source for heating and fixing. In addition, the fixing unit 100 includes a pressure roller 102 that is pressed to the heating unit 101. In addition, the fixing unit 100 includes a frame 107 accommodating the rotatable fixing member, the pressure roller 102, and a capture member 109 which will be described below. The heating unit 101 and the pressure roller 102 form a fixing nip portion N that pinches and conveys the sheet S. The sheet S is fixed by being heated while passing through the fixing nip portion N. Next, the sheet S travels along a sheet discharge path 5, and a discharge roller pair 6 discharges the sheet S to the outside of the image forming apparatus 1. Consequently, the sheet S is placed on a discharge tray (face-down tray) 7.

The above description has been made, assuming that the image forming apparatus 1 is in a face-down discharge mode using the face-down tray 7. This face-down tray 7 receives a recording material with a printed image face-down.

As illustrated in FIG. 2, the image forming apparatus 1 according to the present exemplary embodiment includes a face-up tray 8 that appears when a user opens an apparatus door 9. The face-up tray 8 receives a recording material with a printed image face-up. The door 9 and the tray 8 may be formed integrally. The image forming apparatus 1 according to the present exemplary embodiment can operate in a face-up discharge mode in which the door 9 is open and a recording material is discharged onto the door 9. Thus, with the image forming apparatus 1 according to the present exemplary embodiment, the user can select the face-down discharge mode in which a recording material is discharged onto the face-down tray 7 or the face-up discharge mode in which a recording material is discharged onto the face-up tray 8, as sheet-passing conditions.

Figure 5:
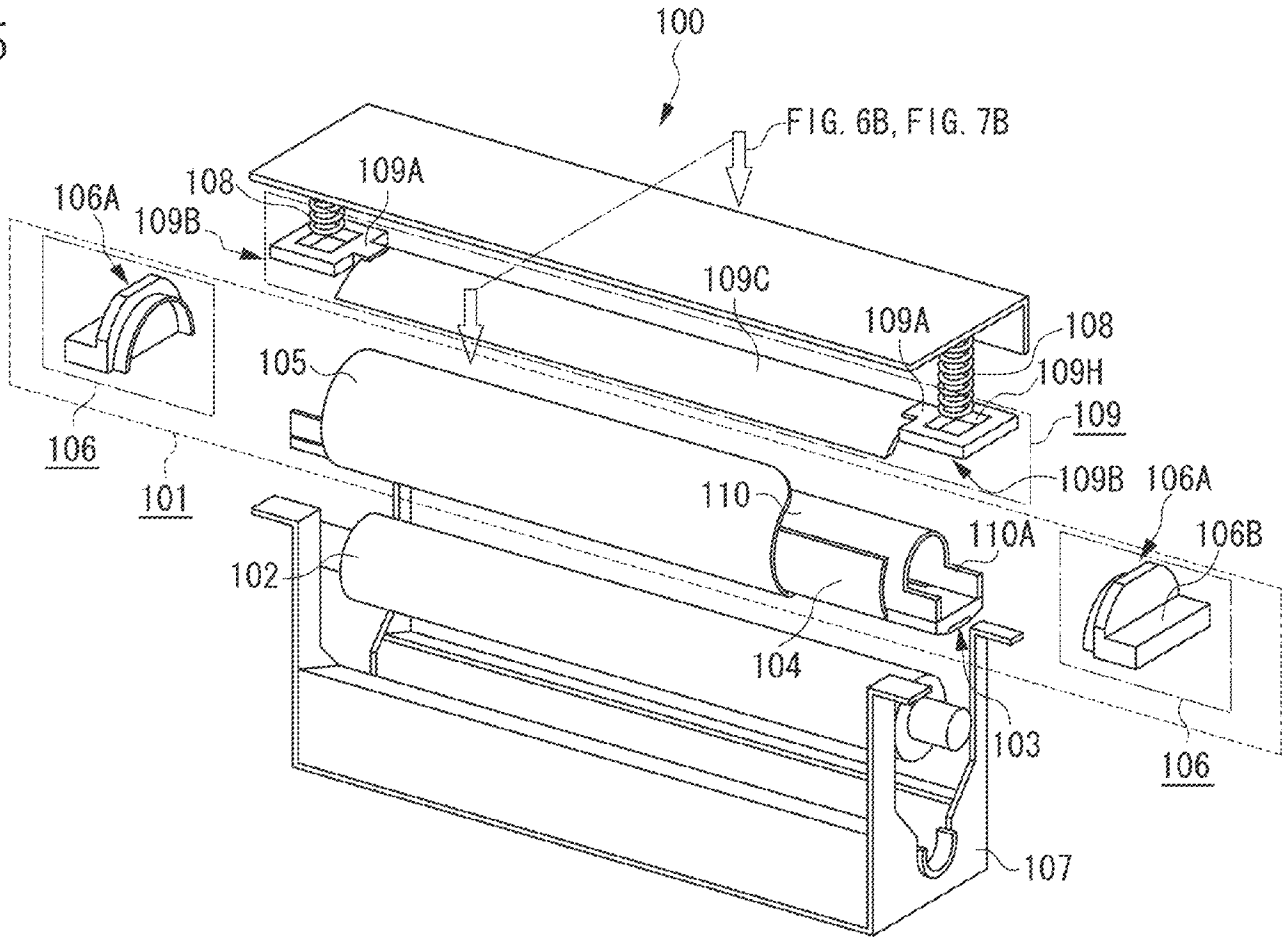
FIG. 5 is an exploded view of a fixing device.
Figure 6B:
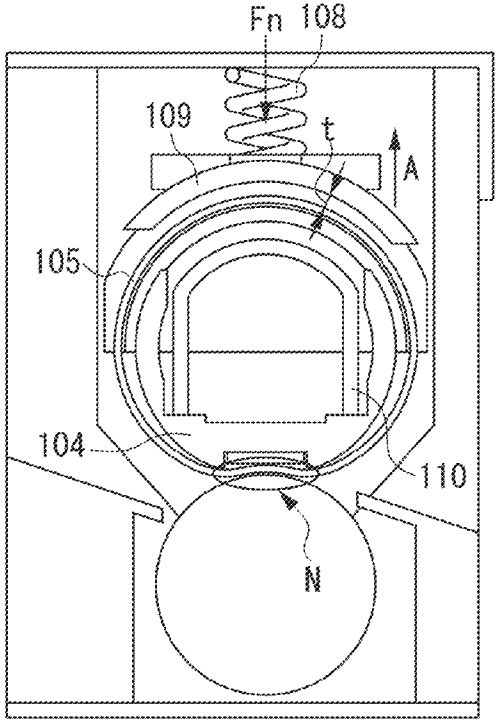
FIGS. 6A and 6B illustrate a capture member with the face-up tray being closed.
Figure 6A:
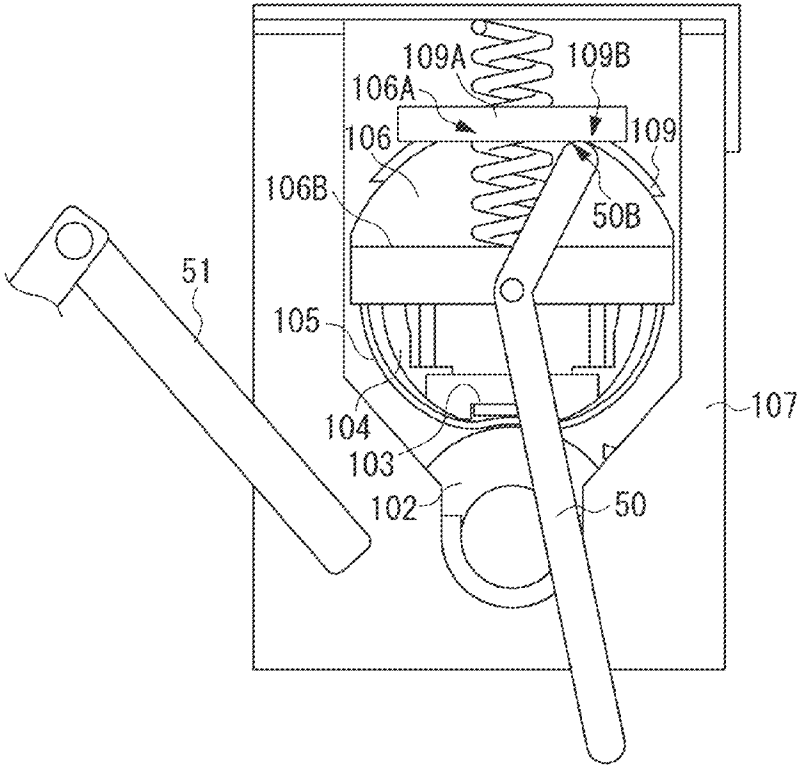
Figure 7B:
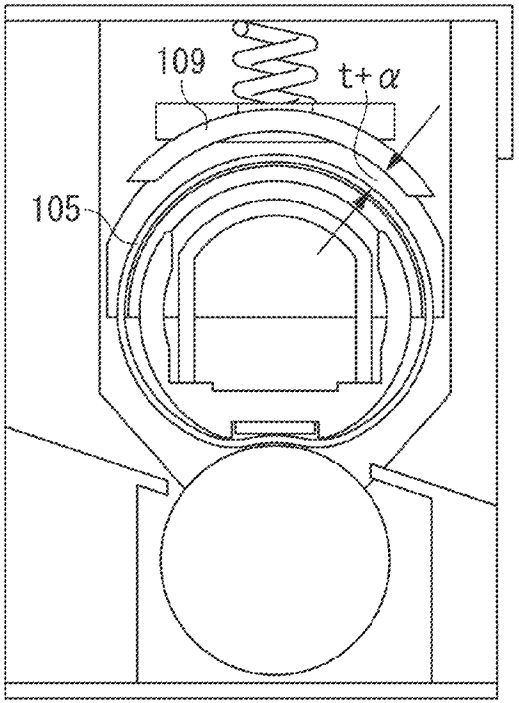
FIGS. 7A and 7B illustrate the capture member with the face-up tray being open.
Figure 7A:
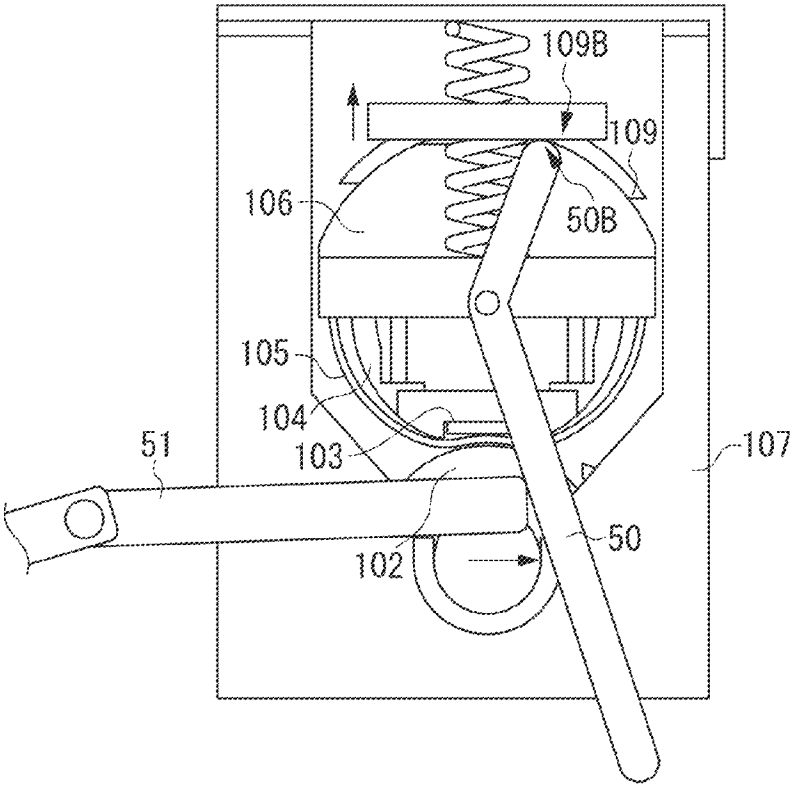

Next, a detailed configuration of the fixing unit 100 included in the image forming apparatus 1 will be described with reference to FIG. 5 to FIGS. 7A and 7B. FIG. 5 is an exploded view of the fixing unit 100, and FIGS. 6A and 6B and FIGS. 7A and 7B are sectional views illustrating a relationship between the fixing film 105 and the capture member 109 in the fixing unit 100. More specifically, FIGS. 6A and 7A are side views of the fixing unit 100. FIGS. 6B and 7B are sectional views of the fixing unit 100, taken along a line perpendicular to the longitudinal direction of the fixing unit 100 (taken along a line indicated by arrows in FIG. 5).

The fixing unit 100 includes the heating unit 101 and the pressure roller (pressure member) 102. When the heating unit 101 is pressed by the pressure roller 102, the fixing nip portion N is formed. The heating unit 101 includes the heater (ceramic heater) 103 serving as a heat source for heating and fixing, a resin heater holder 104 supporting the heater 103, and an endless-belt-type fixing film (rotatable fixing member) 105 that rotates around the heater holder 104, that is into direct contact with the sheet S, and that transfers heat to the sheet S. For the fixing film 105, resin such as polyimide or metal such as stainless steel is used as a base layer. As needed, a rubber layer may be arranged on such base layer. The heater holder 104 is reinforced by a metal stay 110. Flanges 106 are arranged, each of which faces an end of the fixing film 105 in the generatrix direction thereof and is arranged on a seating surface 110A at an end of the stay 110. Each flange 106 serves as a restriction member that restricts movement of the fixing film 105 in the generatrix direction. The flanges 106 also hold the heater holder 104 so that the entire heating unit 101 is supported by the frame 107 of the fixing unit 100. The pressure roller 102 is also supported by the frame 107. Pressure springs (a pressure application mechanism) 108 are arranged for forming the fixing nip portion N. Each pressure spring 108 passes through a hole portion 109H of a capture member 109 and presses a seating surface 106B of the corresponding flange 106. As illustrated in FIG. 6B, when the flanges 106 are pressed by pressure Fn from the respective pressure springs 108, the heating unit 101 and the pressure roller 102 are pressed to each other. As a result, the fixing nip portion N is formed. Namely, the pressure application mechanism applies pressure to the nip portion via the restriction members 106. At the fixing nip portion N, fixing processing is performed on the sheet S bearing a toner image formed by using toner including the wax component.

Next, a configuration for capturing a component vaporized from wax will be described with reference to FIGS. 5 to 7B. The capture member 109 (capture member capturing a component vaporized by heating) captures a component, which has been vaporized from wax and then solidified, in a liquid state (by using wetting). Namely, by causing intermolecular force between the component vaporized from wax and the capture member 109, this component is adsorbed onto the capture member 109. Since the capture member 109 is required to have heat resistance, engineering plastic can suitably be used as material of the capture member 109. PBT (polybutylene terephtalate) is used as material of the capture member 109 according to the present exemplary embodiment. The capture member 109 has first abutment portions 109A that abut on abutment portions 106A of the flanges 106, second abutment portions 109B that abut on a lever 50 which will be described below, and a capture portion 109C onto which the wax component is adsorbed. The capture portion 109C of the capture member 109 is heated by radiant heat from the heat source 103 (via the fixing film 105). In the present exemplary embodiment, the capture portion 109C is configured to have a thickness of 1 mm so that the capture portion 109C is quickly heated by reception of the radiant heat. During fixing processing, the temperature of the capture portion 109C changes within a temperature range in which at least one type of wax component remains in a liquid state by reception of the radiant heat. Thus, the capture member 109 is arranged adjacent to a surface of the fixing film 105 (facing a curved surface portion of the fixing film 105). A distance t between the capture portion 109C and the fixing film 105 illustrated in FIG. 6B is set so that the temperature of the capture portion 109C remains within the above range (the distance when the first abutment portions 109A of the capture member 109 are positioned at the respective abutment portions 106A of the flanges 106). In the present exemplary embodiment, the distance t is set 2 mm. The capture portion 109C faces the outer surface of the fixing film 105 and effectively receives heat from the fixing film 105. Thus, the capture portion 109C can easily be heated. The distance t, which is the distance when the first abutment portions 109A of the capture member 109 are positioned at the respective abutment portions 106A of the flanges 106, is suitable during the face-down discharge mode. The distance t varies depending on various parameters, such as the temperature range in which the capture member 109 needs to remain during fixing processing, the heat capacity of the capture member 109 that changes depending on the material or shape of the capture member 109, and the control target temperature of the heating unit 101.

As described above, the fixing unit 100 according to the present exemplary embodiment includes the rotatable fixing member 105 for heating and fixing a toner image formed on a recording material within the frame 107. In addition, the fixing unit 100 includes the capture member 109, which is heated by radiant heat from the heating and fixing heat source 103 so that the component vaporized during fixing processing is captured in a liquid state.

The capture member 109 can be separated from the fixing film 105 by more than the distance t. More specifically, in the face-up discharge mode, a distance t+α can be set between the capture member 109 and the fixing film 105. In the present exemplary embodiment, α is set to 1 mm. Namely, the distance t+α is set to 3 mm.

When printing in the face-up discharge mode, the door 9 is open. Thus, the air flow within the fixing device 100 during printing in the FU discharge mode differs from that during printing in the FD discharge mode. With the image forming apparatus 1 according to the present exemplary embodiment, the ambient temperature in the fixing device 100 during printing in the face-up discharge mode has been found to be higher than that during printing in the face-down discharge mode. It is probably fair to assume that this is because the air flow within the fixing device 100 is smaller in the face-up discharge mode than in the face-down discharge mode. Thus, even when the printer installation environment or the heater control temperature is the same, if the image forming apparatus 1 is in the face-up discharge mode, the temperature around the fixing film 105 is easily increased, compared with that in the face-down discharge mode. To accommodate such change of sheet-passing conditions, the capture member 109 according to the present exemplary embodiment is configured to be movable. Next, a movement mechanism of the capture member 109 will be described.

[Configuration for moving the capture member 109 when discharge ports are switched] Positions of the capture member 109 when the discharge ports are switched will be described with reference to FIG. 3 to FIGS. 7A and 7B. As described above, the capture member 109 is positioned when the abutment portions 109A, which are parts of the capture member 109, abut on the abutment portions 106A of the flanges 106. This position is suitable in the face-down discharge mode. The capture member 109 can move from this position in a radial direction of the fixing film 105 (in the direction of an arrow A in FIG. 6B).

Figure 3:
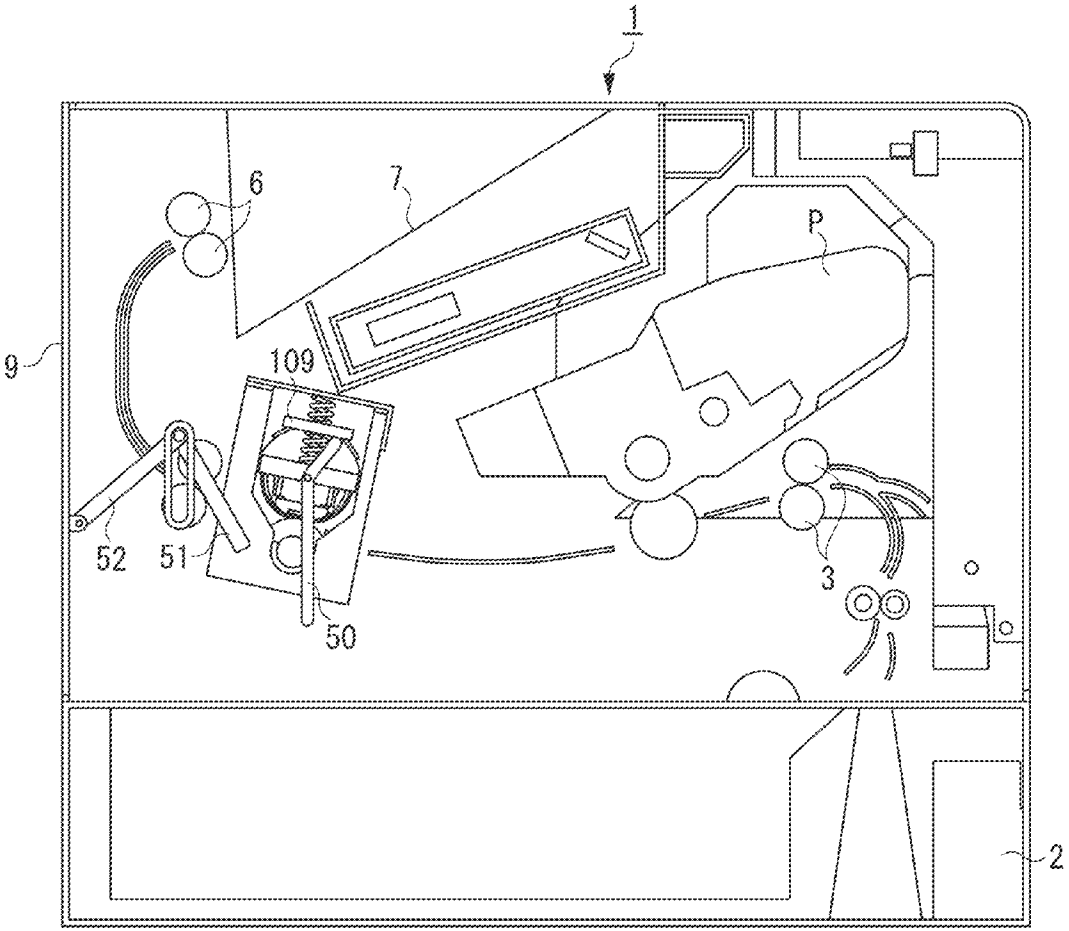
FIG. 3 illustrates a capture member movement mechanism with the face-up tray being closed.

Links (moving members) 51 and 52 are connected to the door 9. These links 51 and 52 are arranged for moving the lever 50 for raising the capture member 109. When the door 9 is closed, the lever 50 and the links 51 and 52 are positioned as illustrated in FIG. 3.

Figure 4:
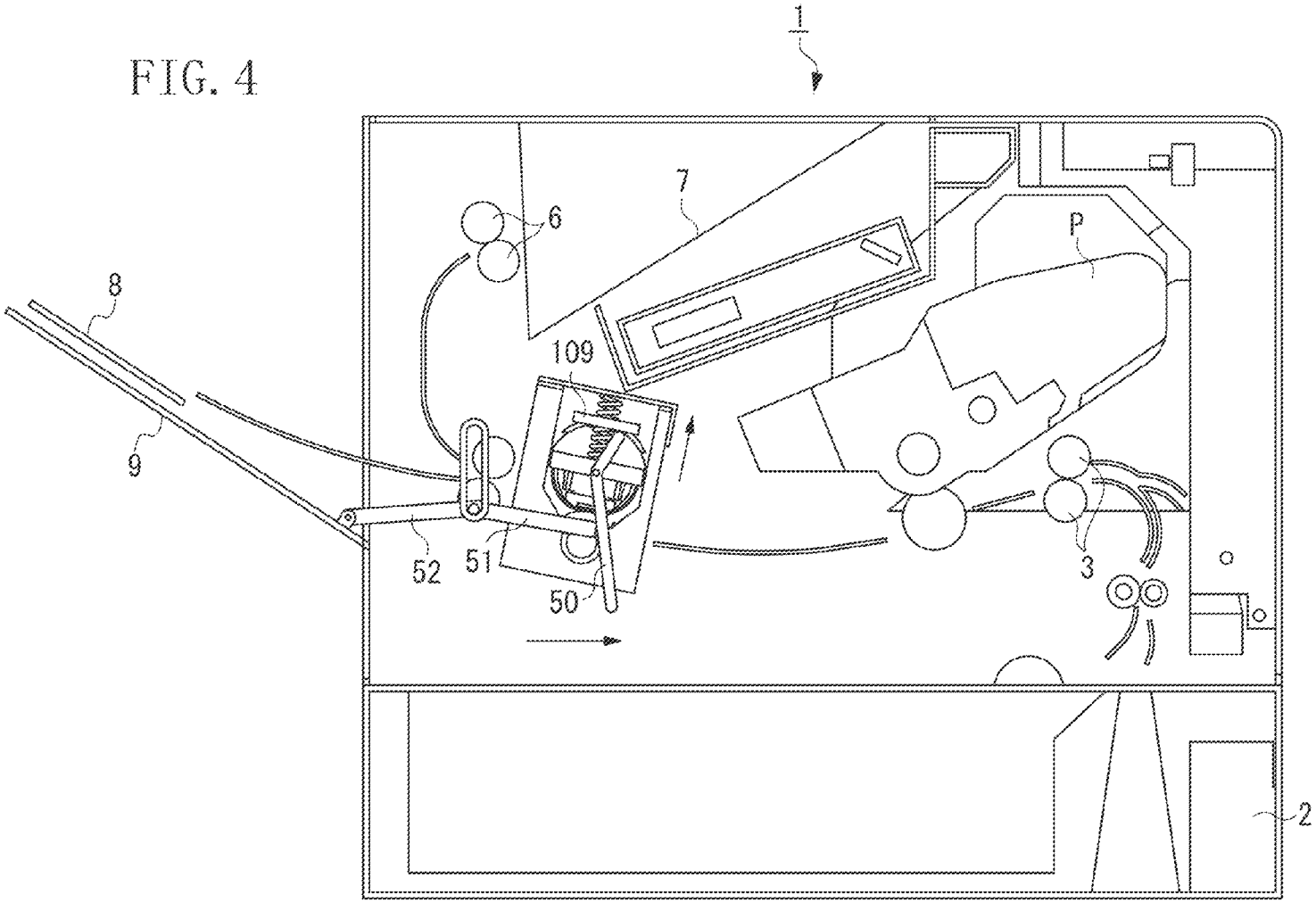
FIG. 4 illustrates the capture member movement mechanism with the face-up tray being open.

As illustrated in FIG. 4, when the door 9 is open, the links 51 and 52 are separated from each other, and the link 51 pushes the lever 50 in the right direction in FIG. 4. The lever 50 is a member arranged to be movable in the fixing device 100. When the link 51 pushes the lever 50, the lever 50 is moved, and a part 50B of the lever 50 raises the second abutment portions 109B of the capture member 109. As a result, the capture member 109 moves in the direction of the arrow A in FIG. 6B, and the first abutment portions 109A of the capture member 109 are separated from the abutment portions 106A of the flanges 106. Through this operation, the capture portion 109C is moved to the position away from the fixing film 105 by the distance t+α (FIGS. 7A and 7B). By achieving this distance t+α, the temperature of the capture portion 109C during fixing processing in the face-up discharge mode can be maintained within the temperature range in which at least one type of wax component remains in a liquid state by reception of the radiant heat.

As described above, according to the present exemplary embodiment, even when the discharge ports (sheet-passing conditions) are switched and the temperature within the fixing device 100 changes thereby, the position of the capture member 109 for capturing the wax component can be changed. In this way, irrespective of the sheet-passing conditions, the capture member 109 can exert the capability of capturing the wax component.

With the image forming apparatus 1 according to the present exemplary embodiment, the ambient temperature within the fixing device 100 in the face-up discharge mode is higher than that in the face-down discharge mode. Thus, the distance between the fixing film 105 and the capture portion 109C in the face-up discharge mode is set to be longer than that in the face-down discharge mode. However, if the ambient temperature within the fixing device 100 in the face-up discharge mode is lower than that in the face-down discharge mode, the distance between the fixing film 105 and the capture portion 109C in the face-up discharge mode can be set to be shorter than that in the face-down discharge mode.

Figure 8:
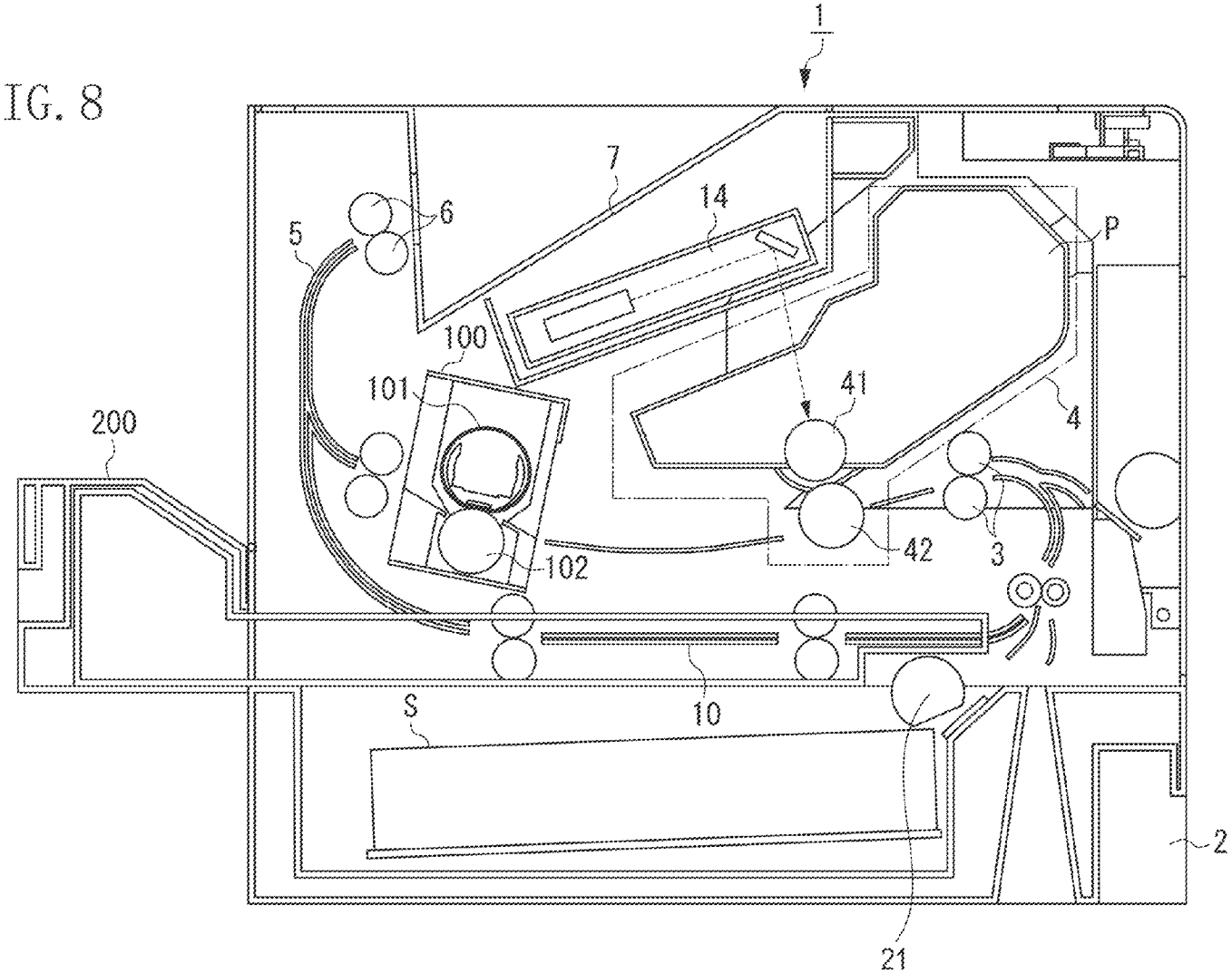
FIG. 8 is a sectional view of an image forming apparatus according to a second exemplary embodiment to which a two-sided conveyance unit is attached.

Next, a second exemplary embodiment will be described. In the present exemplary embodiment, a two-sided printing mode is used as a sheet-passing condition. More specifically, the position of the capture member 109 is changed between printing the first side and printing the second side in a two-sided printing mode. FIG. 8 is a sectional view of the image forming apparatus 1 to which a two-sided conveyance unit 200 is attached. By attaching the two-sided conveyance unit 200 to the image forming apparatus 1, two-sided printing can be performed. Of course, when this two-sided conveyance unit 200 is attached, one-sided printing can be performed.

When the first side of a sheet S is printed during two-sided printing, the sheet S is conveyed along the same path as that used in a normal one-sided printing operation. However, after the sheet S reaches the discharge roller pair 6, the discharge roller pair 6 reversely conveys the sheet S by using the trailing edge of the sheet S as the leading edge thereof. Next, the sheet S is conveyed along a two-sided conveyance path 10 and travels along the normal conveyance path, with the printed first side face-down. Subsequently, the second side of the sheet S is printed. After the fixing unit 100 completes fixing processing on the second side, the sheet S is conveyed along the sheet discharge path 5 and is discharged by the discharge roller pair 6 to the outside of the image forming apparatus 1. In this way, the sheet S is placed on the discharge tray 7.

Figure 9:
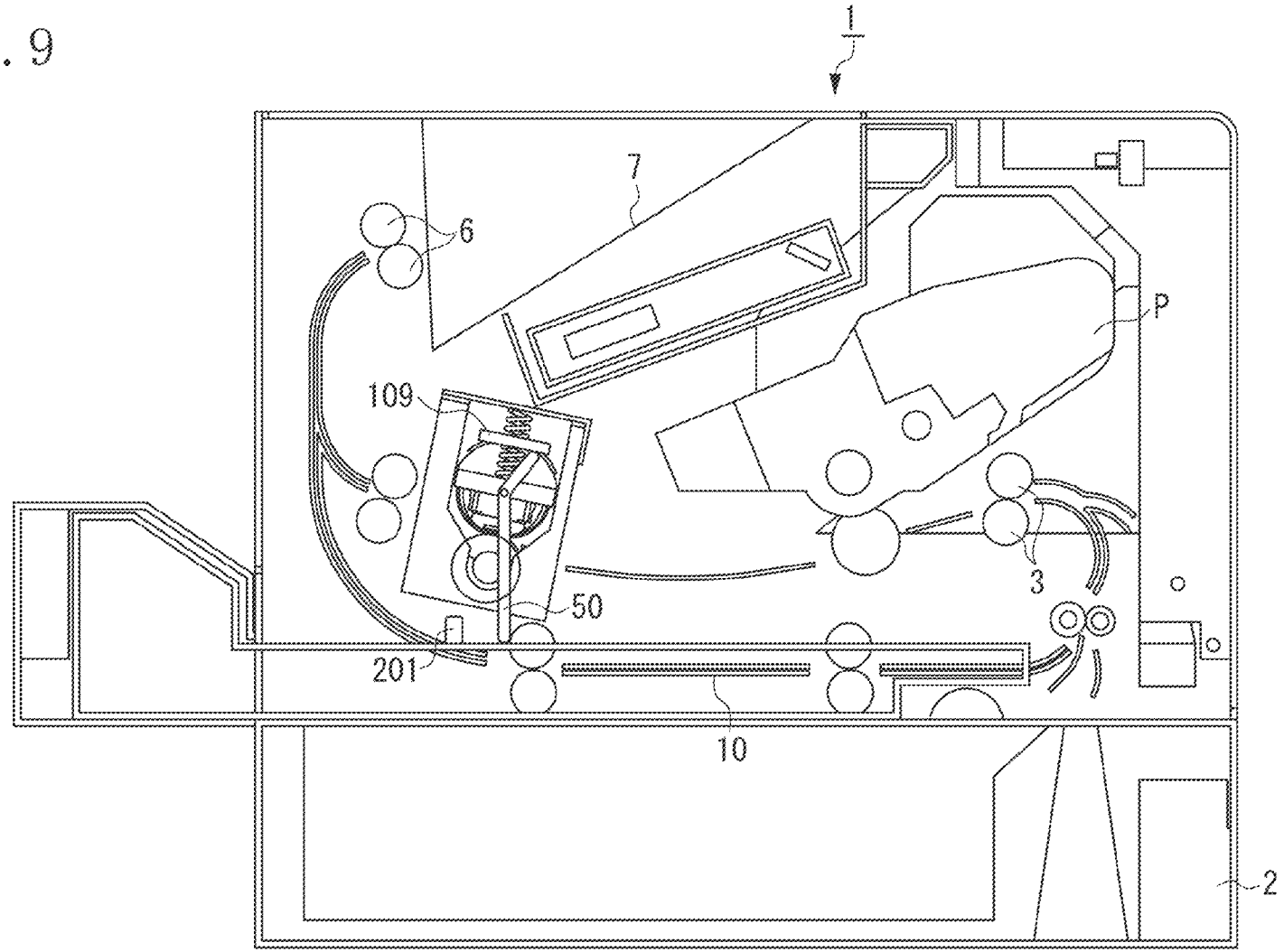
FIG. 9 illustrates a capture member movement mechanism according to the second exemplary embodiment during one-sided printing.
Figure 10:
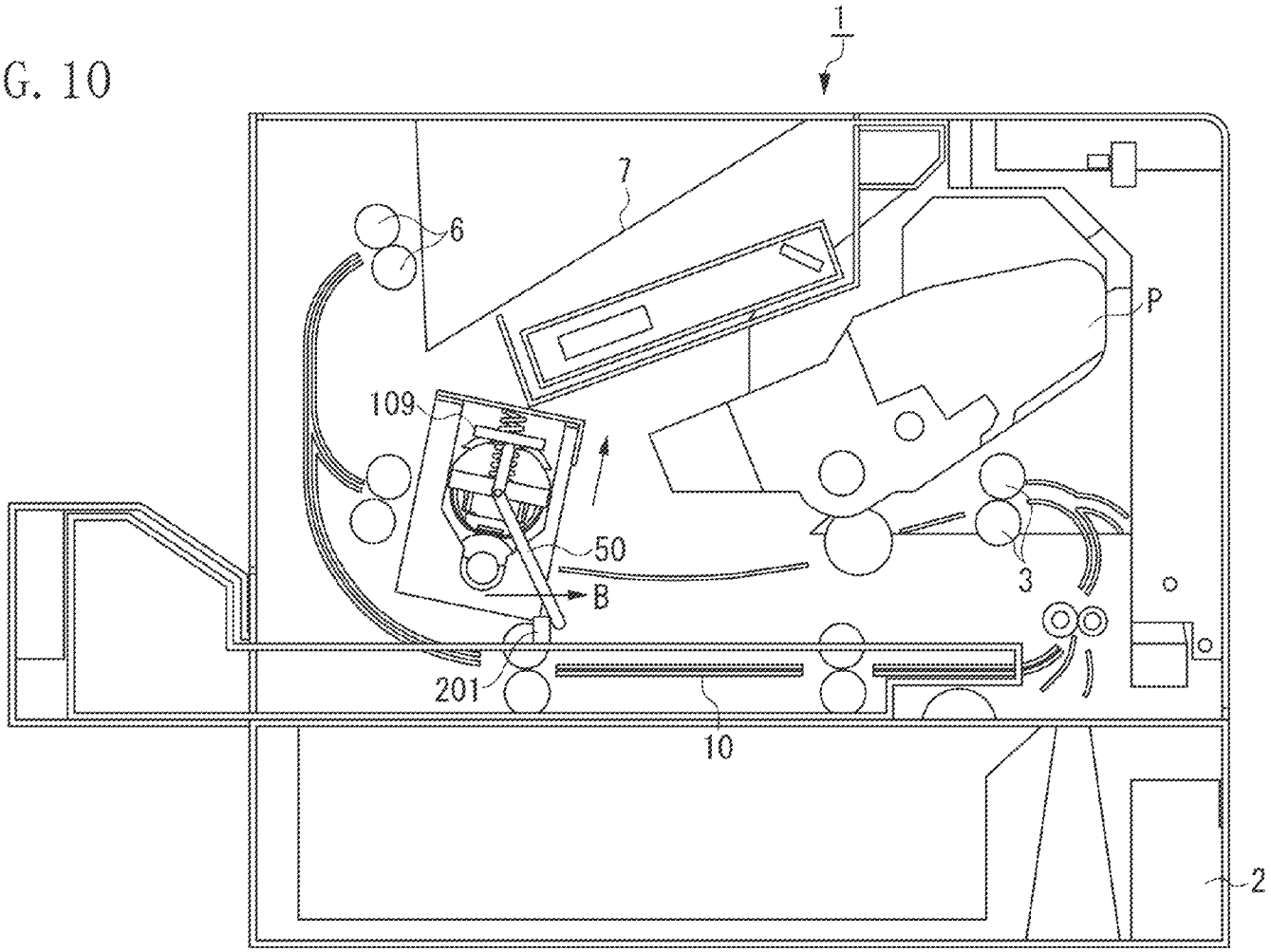
FIG. 10 illustrates the capture member movement mechanism according to the second exemplary embodiment during two-sided printing.

Since the fixing unit 100 according to the present exemplary embodiment has the same configuration as that according to the first exemplary embodiment, redundant description thereof will be avoided. FIG. 9 is a sectional view of the image forming apparatus 1 when the first side of a sheet S is printed (when printing the first side). FIG. 10 is a sectional view of the image forming apparatus 1 when the second side of the sheet S is printed (when printing the second side). After the second side is printed and the sheet S is conveyed to the fixing unit 100, the sheet has already been heated by the first fixing processing. For this reason, when fixing processing is performed on the second side, the ambient temperature within the fixing device 100 is easily increased. In addition, the temperature of the capture member 109 is easily increased.

Figure 11B:
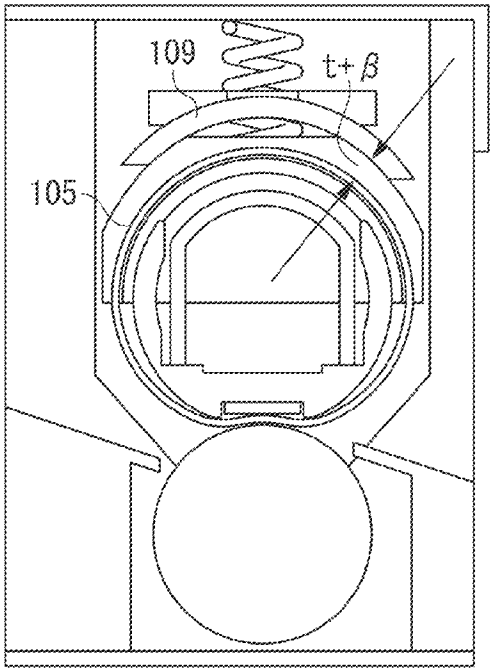
FIGS. 11A and 11B illustrate a capture member according to the second exemplary embodiment during two-sided printing.
Figure 11A:
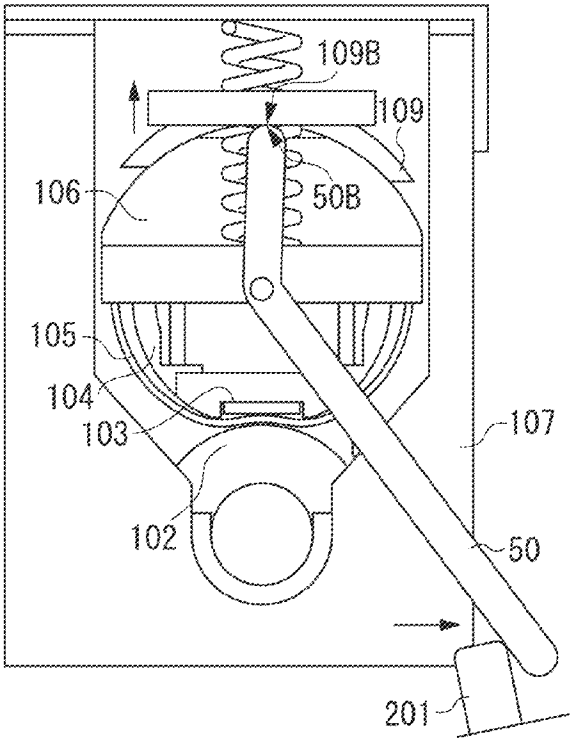

As illustrated in FIG. 9 to FIGS. 11A and 11B, the two-sided conveyance unit 200 includes a moving member 201 for moving the lever 50. The moving member 201 can move in conjunction with driving of a two-sided conveyance unit drive motor (not illustrated). Even when the two-sided conveyance unit 200 is attached to the image forming apparatus 1, when the first side is printed, the two-sided conveyance unit 200 does not operate. Thus, as illustrated in FIG. 9, the moving member 201 does not move from an initial position thereof. When the second side is printed, since the two-sided conveyance unit drive motor is driven, the moving member 201 moves in the direction of an arrow B as illustrated in FIG. 10 to move the lever 50. In this way, the capture member 109 can be moved, as in the first exemplary embodiment. Through such operation, the capture portion 109C moves to a position away from the fixing film 105 by a distance t+β (FIGS. 11A and 11B). By achieving this distance t+β, the temperature of the capture portion 109C during fixing processing on the second side in the two-sided printing mode can be maintained within the temperature range in which at least one type of wax component remains in a liquid state by reception of the radiant heat. In the present exemplary embodiment, β is set to 2 mm, and the distance t+β is set to 4 mm.

As described above, according to the present exemplary embodiment, even when the print side in two-sided printing (sheet-passing condition) changes and the temperature within the fixing device 100 changes, the position of the capture member 109 for capturing a wax component can be changed. In this way, irrespective of the sheet-passing condition, the capture member 109 can exert the capability of capturing a wax component.

With the image forming apparatus 1 according to the present exemplary embodiment, when fixing processing is performed on the second side, the ambient temperature within the fixing device 100 is higher than that when fixing processing is performed on the first side. Thus, the distance between the fixing film 105 and the capture portion 109C when fixing processing is performed on the second side is set to be longer than that when fixing processing is performed on the first side. However, if the ambient temperature within the fixing device 100 when fixing processing is performed on the second side is lower than that when fixing processing is performed on the first side, the distance between the fixing film 105 and the capture portion 109C when fixing processing is performed on the second side can be set to be shorter than that when fixing processing is performed on the first side.

In the above first and second exemplary embodiments, techniques for collecting the component vaporized from wax have been described. However, when grease applied to the inner surface of the fixing film 105 to improve rotational siding properties of the fixing film 105 is heated by the heater 103, the grease could be vaporized. Thus, to accommodate such case, the distance from the fixing film 105 may be set so that the capture member 109 is at a temperature suitable for capturing the capture target. In addition, there are cases where the temperature at which the capture target remains in a liquid state overlaps the temperature range in which the wax component remains in a liquid state. In such cases, the distance from the fixing film 105 may be set so that the temperature of the capture member 109 falls within the overlapping temperature range.

In addition, the heating unit 101 according to the first and second exemplary embodiments uses a film heating and pressing technique using the fixing film 105. However, alternatively, a heat roller technique using a heat roller may be used. If a heat roller technique is used, the capture member 109 can be positioned with respect to a bearing receiving the rotation shaft of the heat roller, and the capture member 109 can be made movable in the radial direction as described above. The same applies to the other exemplary embodiments, which will be described below.

Figure 12:
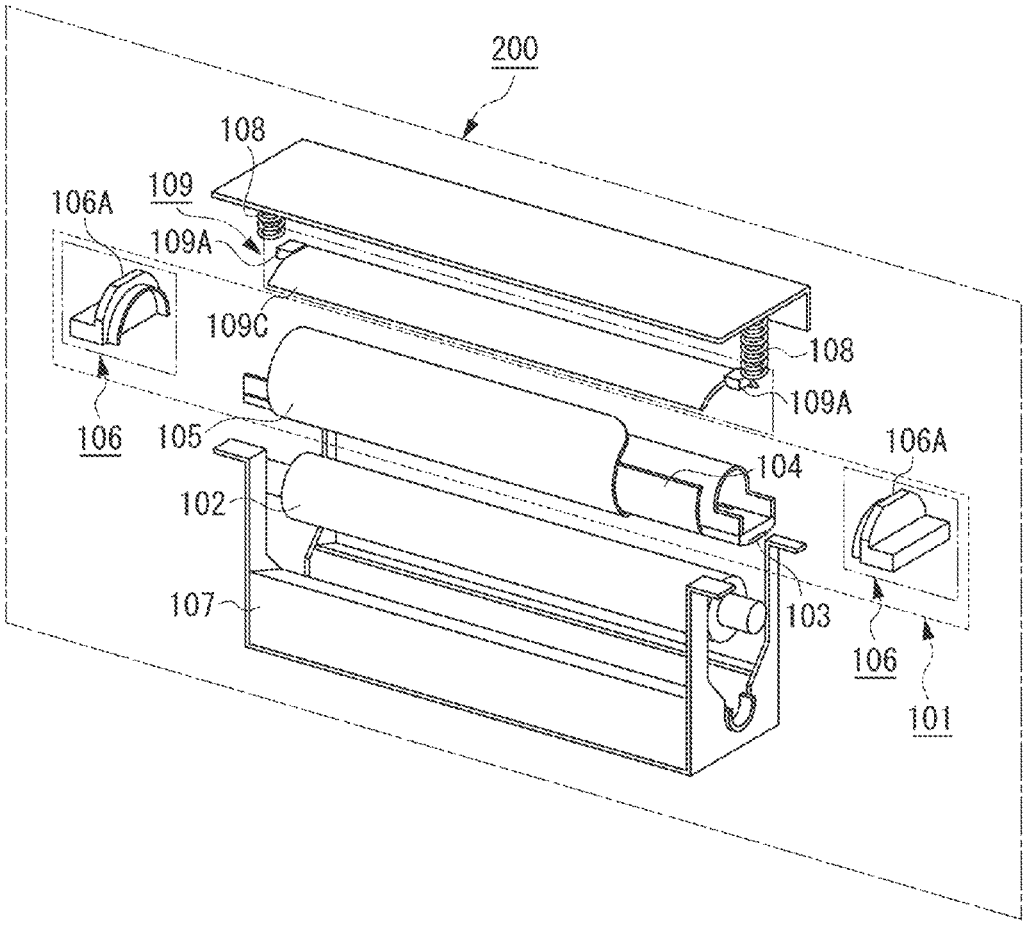
FIG. 12 is an exploded perspective view of a fixing device according to a third exemplary embodiment.
Figures 13A, 13B:
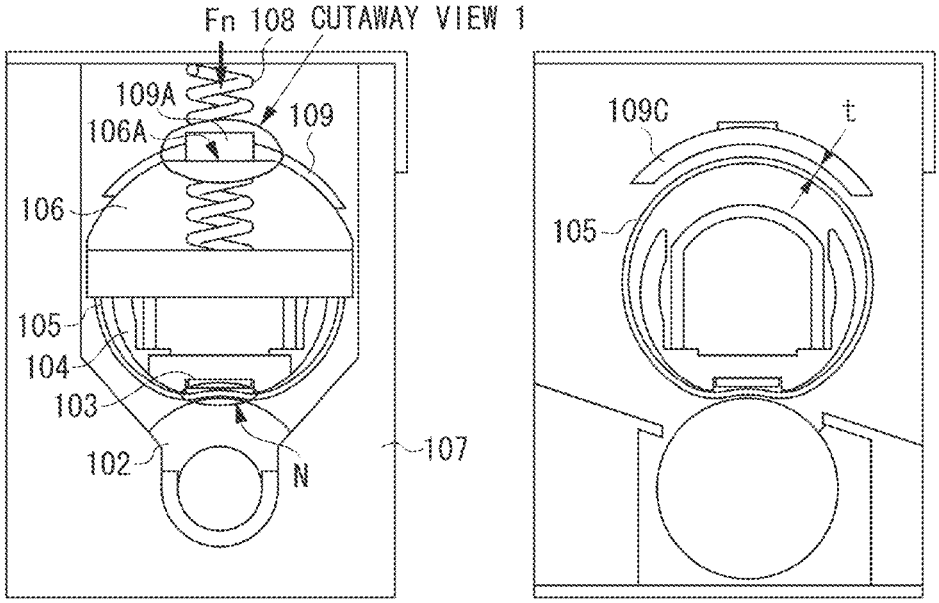
FIGS. 13A and 13B are a side view and a sectional view of the fixing device according to the third exemplary embodiment, respectively.

In an image forming apparatus according to a third exemplary embodiment, the capture member 109 is fixed to the flanges 106. Since the capture member 109 does not move, the capture member 109 is not provided with the second abutment portions as described in the first exemplary embodiment. FIG. 12 is an exploded perspective view of a fixing device 200 according to the third exemplary embodiment. FIGS. 13A and 13B are a side view and a sectional view of the fixing device 200, respectively. Other configurations of the capture member 109 are the same as those according to the first exemplary embodiment.

Thus, by causing the abutment portions 106A of the flanges 106 to hold and fix the capture member 109, the vaporized component of wax can also be captured. If the present exemplary embodiment is used, the capture member 109 and the flanges 106 may be formed as an integrally-molded product.

Next, an image forming apparatus according to a fourth exemplary embodiment will be described with reference to FIG. 14 and FIGS. 15A to 15D. A fixing device 300 according to the present exemplary embodiment includes a function of releasing the pressure applied to the fixing nip portion N, and the capture member 109 moves in conjunction with the pressure release operation. A pressure release state is set when a user removes a recording material jammed at the fixing nip portion N or when the power supply of the apparatus is turned off, for example.

Figure 14:
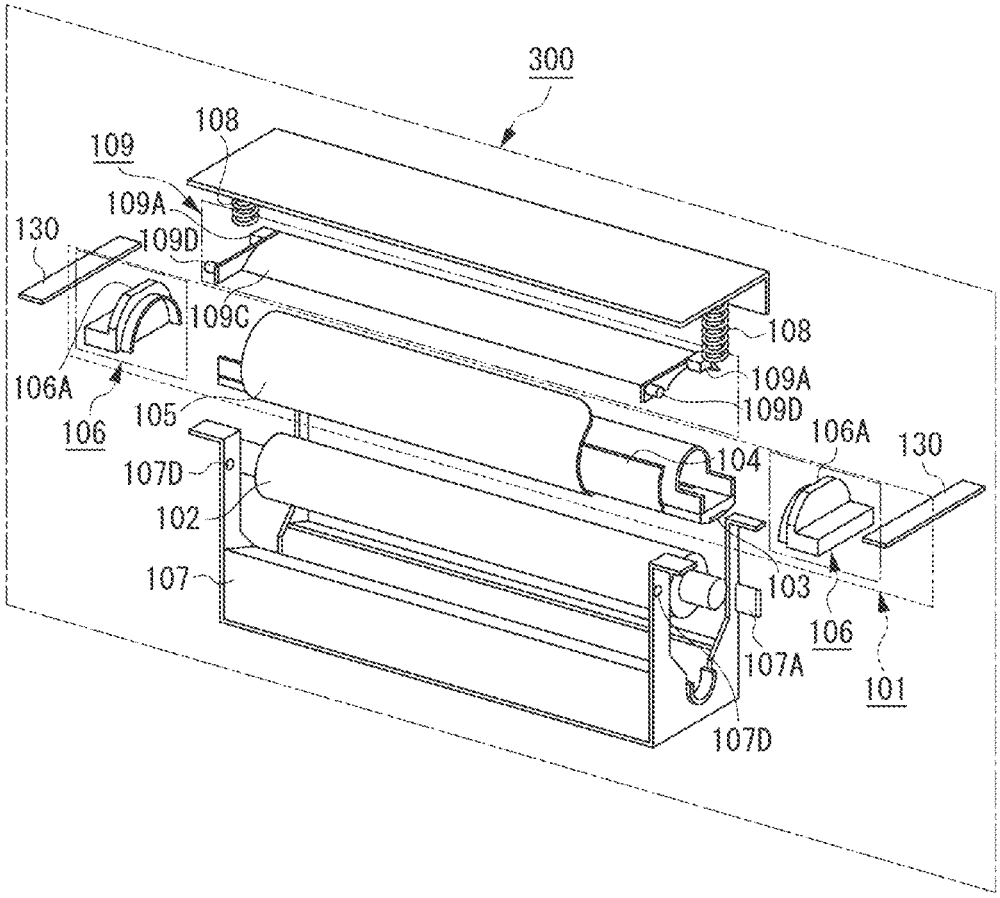
FIG. 14 is an exploded perspective view of a fixing device according to a fourth exemplary embodiment.
Figures 15A, 15B:
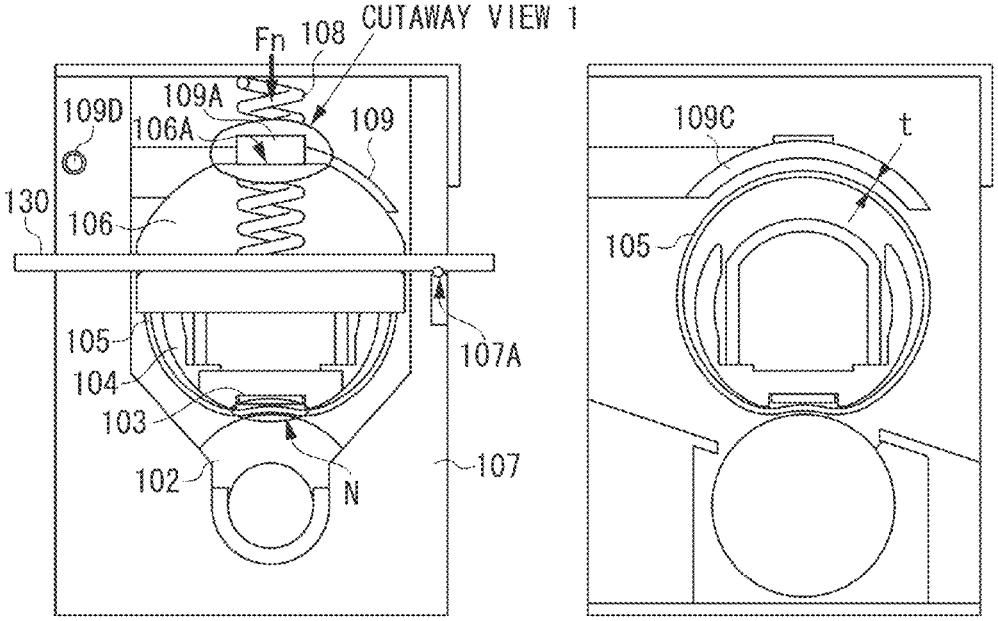
FIGS. 15A, 15B, 15C, and 15D are side views and sectional views of the fixing device according to the fourth exemplary embodiment.
Figures 15C, 15D:
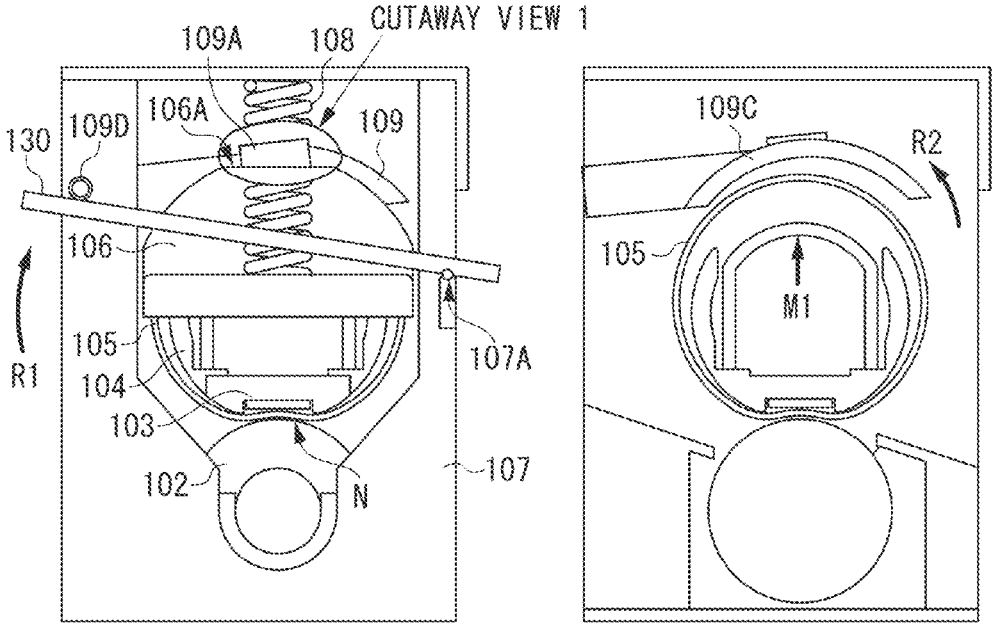

As illustrated in FIG. 14, the capture member 109 is provided with a shaft 109D and the frame 107 of the fixing unit has a hole 107D that fits the shaft 109D. The capture member 109 is held rotatably about the shaft 109D that fits the hole 107D. In addition, on either side, a pressure plate 130 for pressing the heating unit 101 is arranged between a flange 106 and a pressure spring 108. These pressure plates 130 can be raised manually or by power from a motor (the pressure applied to the fixing nip portion N can be reduced). Namely, the fixing device 300 according to the present exemplary embodiment has a pressure release mechanism for releasing the pressure applied to the fixing nip portion N. The pressure plates 130 can rotate in the direction of an arrow R1 about a fulcrum 107A of the frame 107. When the pressure plates 130 rotate in the direction of the arrow R1, the springs 108 are compressed as illustrated in FIG. 15C. As a result, the pressure applied to the flanges 106 is reduced and the pressure applied to the fixing nip portion N is released. When the pressure is released, since the pressure roller 102 having a rubber layer is released from the pressure applied by the springs 108, the heating unit 101 is raised in the direction of an arrow M1 in FIG. 15D. In addition, since the flanges 106 are also moved in the direction of the arrow M1, the capture member 109 held by the flanges 16 are rotated in the direction of an arrow R2 illustrated in FIG. 15D about the shaft 109D. Namely, when the pressure applied to the nip portion N is released by the pressure release mechanism, the restriction members are moved, and the capture member 109 is also moved along with the movement of the restriction members.

In this way, even when the pressure is released and the heating unit 101 is moved, a suitable distance can be ensured between the capture member 109 and the fixing film 105. As a result, the fixing film 105 can be protected.

Figure 16:
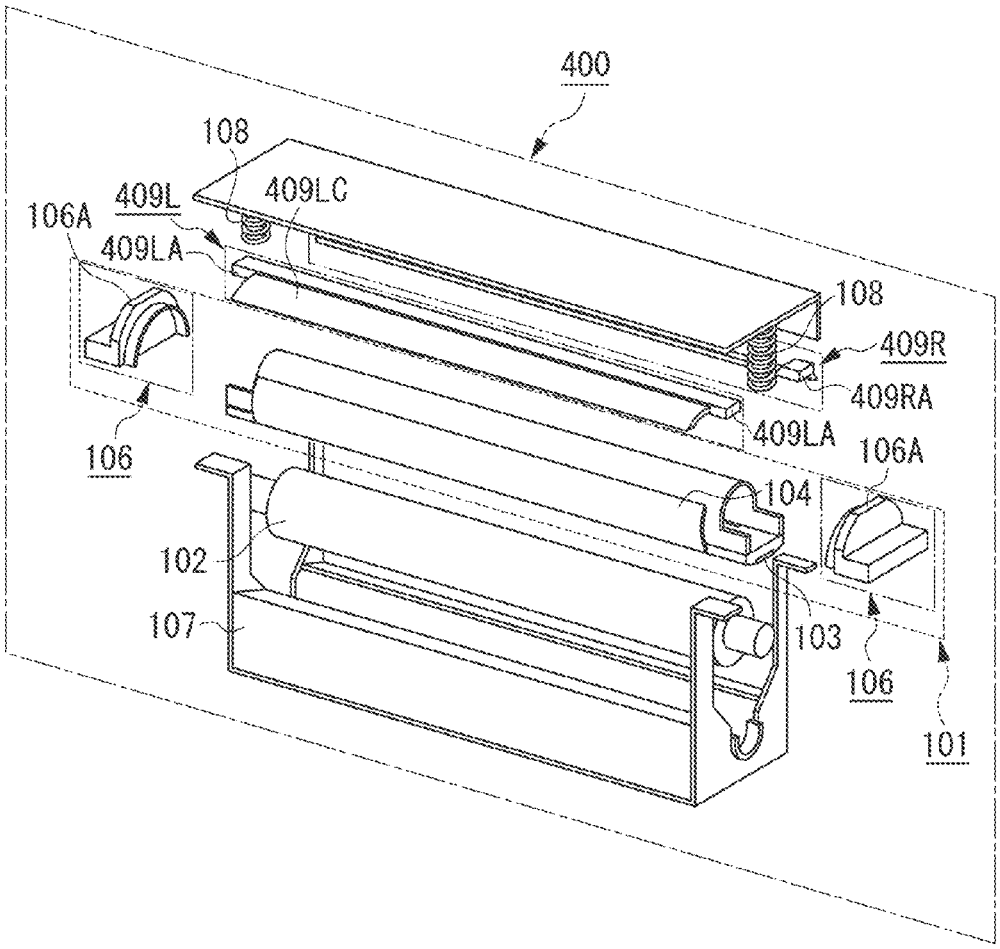
FIG. 16 is an exploded perspective view of a fixing device according to a fifth exemplary embodiment.
Figures 17A, 17B:
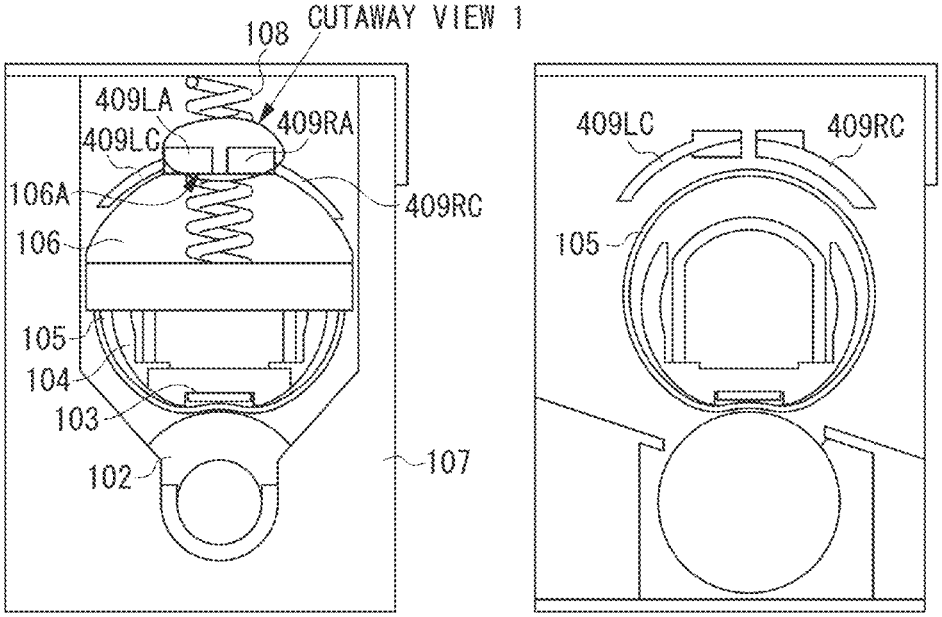
FIGS. 17A and 17B are a side view and a sectional view of the fixing device according to the fifth exemplary embodiment, respectively.

Next, a fixing device 400 according to a fifth exemplary embodiment will be described with reference to FIG. 16 and FIGS. 17A and 17B. The fixing device 400 according to the present exemplary embodiment includes a plurality of capture members. The fixing device 400 includes two capture members 409L and 409R. These two capture members 409L and 409R are held by allowing first abutment portions (409LA and 409RA) to abut on the respective abutment portions 106A of the flanges 106. Each of the capture members 409LC and 409RC is a capture portion having the same function as that of the capture portion 109C according to the first exemplary embodiment. In FIG. 16, the fixing film 105 is not illustrated.

The capture members 409L and 409R may have the same shape and the same heat capacity. However, in the present exemplary embodiment, at least the material or the shape is made different so that the heat capacity differs between these two capture members 409L and 409R. In this way, when heated by radiant heat from the heating unit 101, the two capture members 409L and 409R exhibit different temperatures. Thus, various vaporized components can be collected. Namely, each of the capture members 409L and 409R is maintained at a different temperature. Alternatively, the distance between the capture member 409L and the fixing film 105 may be set to be different from the distance between the capture member 409R and the fixing film 105.

Figure 18A:
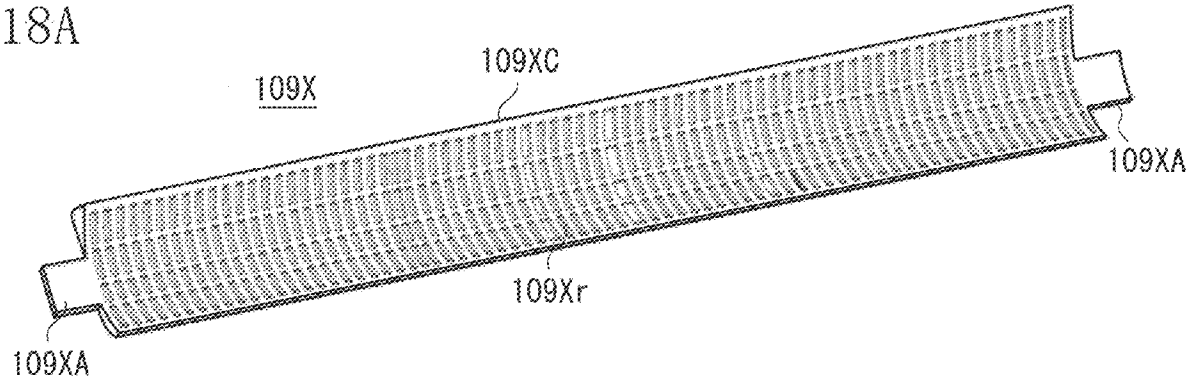
FIGS. 18A and 18B are perspective views of capture members according to a sixth exemplary embodiment.
Figure 18B:
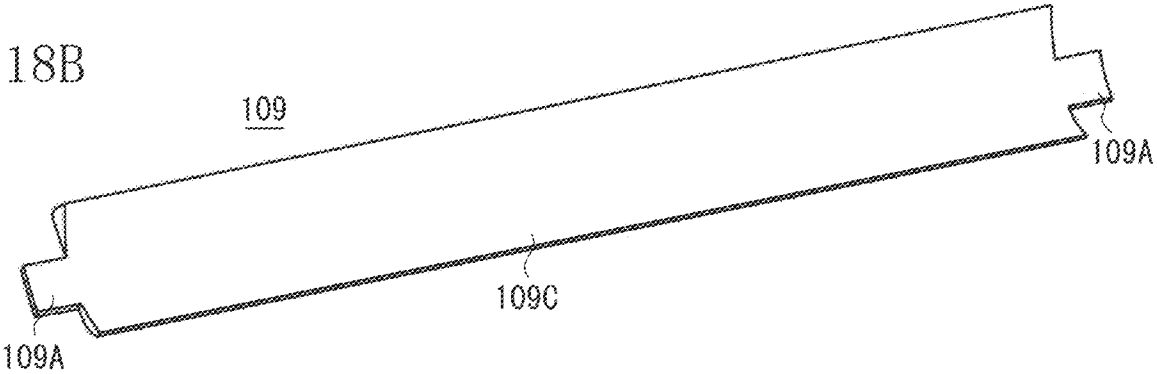

FIG. 18A illustrates another example of the capture member. A capture member 109X according to the present exemplary embodiment is provided with many ribs 109Xr in a surface facing the fixing film 105. FIG. 18B illustrates a capture member without such ribs.

When FIG. 18A and FIG. 18B are compared, it is seen that the surface area of a capture portion 109XC of the capture member 109X is about 1.8 times larger than that of the capture portion 109C of the capture member 109. Namely, while the capture portion 109XC and the capture portion 109C have the same projected area, since the capture portion 109XC has a larger surface area, the capture portion 109XC has better capture capability.

Figure 19A:
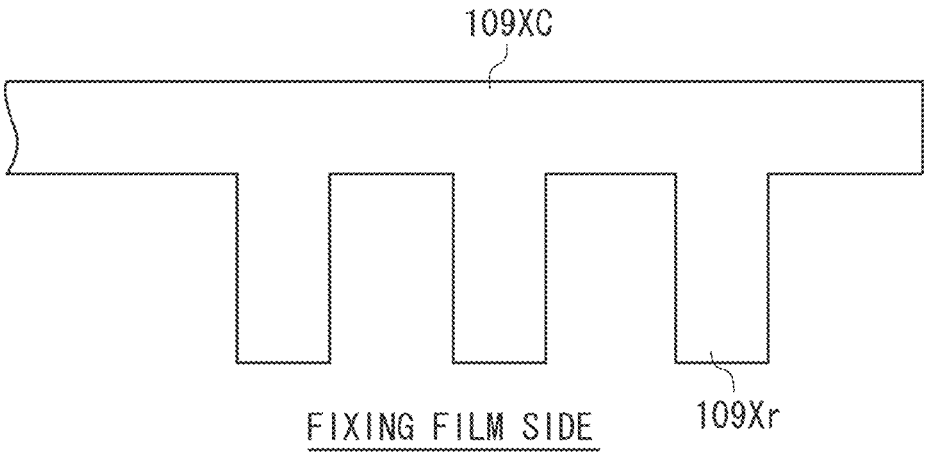
FIGS. 19A and 19B are perspective views of capture members according to the sixth exemplary embodiment.
Figure 19B:
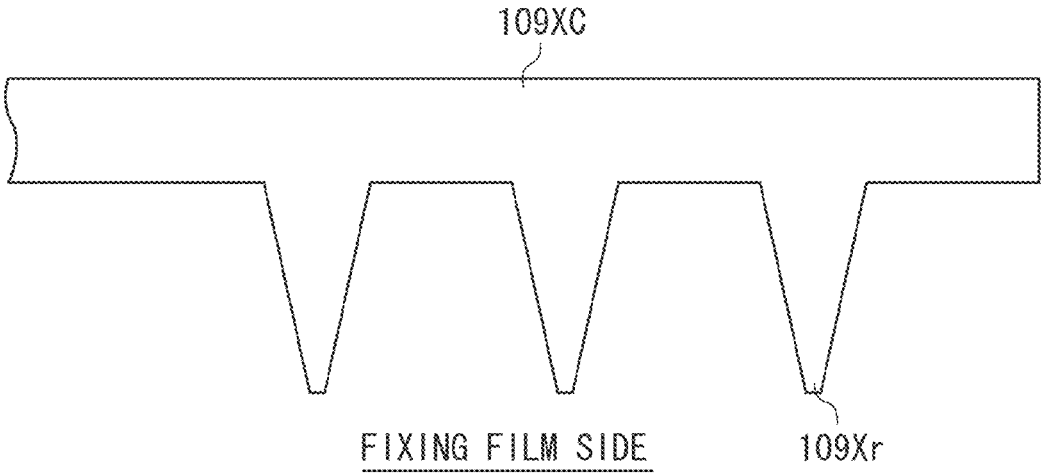

FIGS. 19A and 19B are sectional views illustrating detailed shapes of the ribs 109Xr. FIG. 19A illustrates ribs having a rectangular sectional shape and FIG. 19B illustrates ribs having a triangular sectional shape. As illustrated in FIG. 19B, if each rib has a tapering leading edge, the heat capacity at the leading edge is decreased. Thus, since the surface on which the vaporized component is adsorbed is quickly heated by radiant heat from the heating unit, the capture effect can be exerted from the initial phase of printing.

Next, a seventh exemplary embodiment will be described. As described above, to efficiently capture the component vaporized from wax or the like, necessary measures need to be taken so that the floating component, which has been vaporized from wax or the like and solidified, easily adheres to the capture member and is not easily vaporized from the capture member again. Thus, it is desirable that the temperature of the capture member be maintained within a temperature range in which the vaporized component remains in a liquid state as long as possible during printing.

However, the temperature of the capture member changes (gradually rises) as time passes during continuous printing. In addition, the suitable control target temperature of the fixing device differs between when fixing unfixed toner images formed on thick sheets and when fixing unfixed toner images formed on thin sheets. The temperature of the capture member also differs depending on such difference in control target temperature (difference in fixing mode).

Thus, in the present exemplary embodiment, the position of the capture member is moved on the basis of information relating to the temperature of the capture member, and the temperature of the capture member is set to be suitable for capturing the vaporized component.

Figure 20:
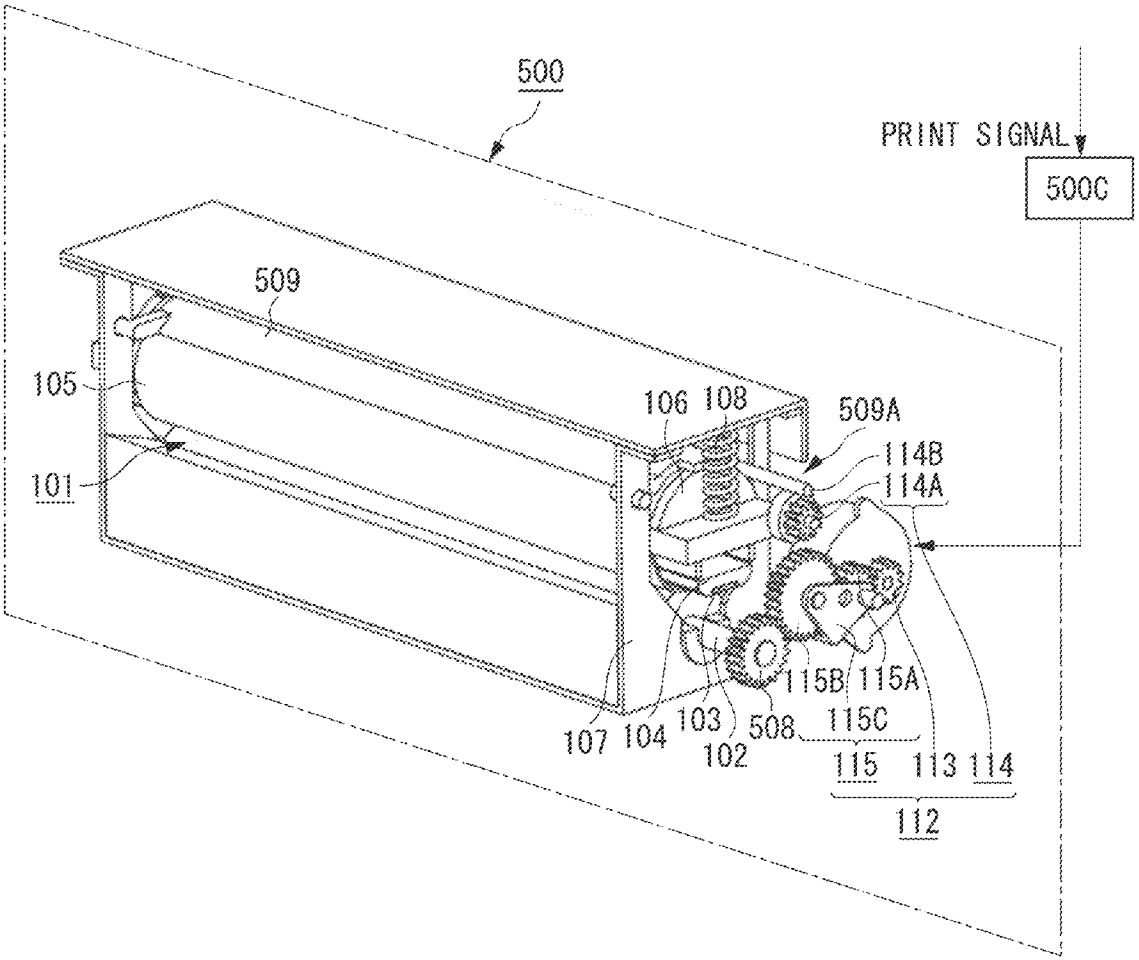
FIG. 20 is a perspective view of a fixing device according to a seventh exemplary embodiment.

FIG. 20 is a perspective view of a fixing device 500 according to the seventh exemplary embodiment. A gear 508 is attached to the shaft of the pressure roller 102, and the pressure roller 102 is rotated by power from a motor 113. A capture member 509 is arranged at a position facing the fixing film 105. The capture member 509 is heated by radiant heat from the heating unit 101. The capture member 509 is supported rotatably with respect to the frame 107 (see FIG. 21). In addition, a cam abutment portion 509A that abuts on a cam 114 for rotating the capture member 509 is formed on the capture member 509. The cam 114 rotates by power from the motor 113. Next, a capture member movement mechanism will be described with reference to FIG. 20 to FIGS. 23A and 23B.

The capture member movement mechanism includes a capture member movement unit 112 for moving the capture member 509 and a central processing unit (CPU) (control unit) 500C for controlling operations of the capture member movement unit 112.

The capture member movement unit 112 includes the motor 113, the cam 114, and a pendulum gear train 115 switching the direction of transmission of power from the motor 113 between the gear 508 and the cam 114. The cam 114 includes a gear portion 114A receiving power from the motor 113 and a cam portion 114B abutting on the abutment portion 509A of the capture member 110. The pendulum gear train 115 includes a gear 115A engaging with the motor 113, a pendulum gear 115B engaging with the gear 508 or the gear portion 114A of the cam 114, and a holder 115C rotatably holding these two gears. The motor 113 can rotate either in the forward direction or in the reverse direction. When the motor 113 rotates in the clockwise direction, the pendulum gear train 115 transmits power to the gear 508 attached to the pressure roller 102. In contrast, when the motor 113 rotates in the counterclockwise direction, the pendulum gear train 115 transmits power to the cam 114.

When receiving a print signal, the control unit 500C controls the capture member movement unit 112 to move the position of the capture member 110. The print signal includes not only image information but also print side information (one-sided printing/two-sided printing) and fixing mode information (high temperature mode/normal temperature mode/low temperature mode), for example. For example, the high temperature mode is set when a thick sheet is specified as a recording material, and in this mode, the heater 103 has a high control target temperature. For example, the low temperature mode is set when a thin sheet is specified as a recording material, and in this mode, the heater 103 has a low control target temperature. For example, the normal temperature mode is set when a plain sheet is specified as a recording material, and in this mode, the heater 103 has a control target temperature between those in the high and low temperature modes. Depending on the set fixing mode, the control target temperature of the heater 103 is changed.

Figure 21:
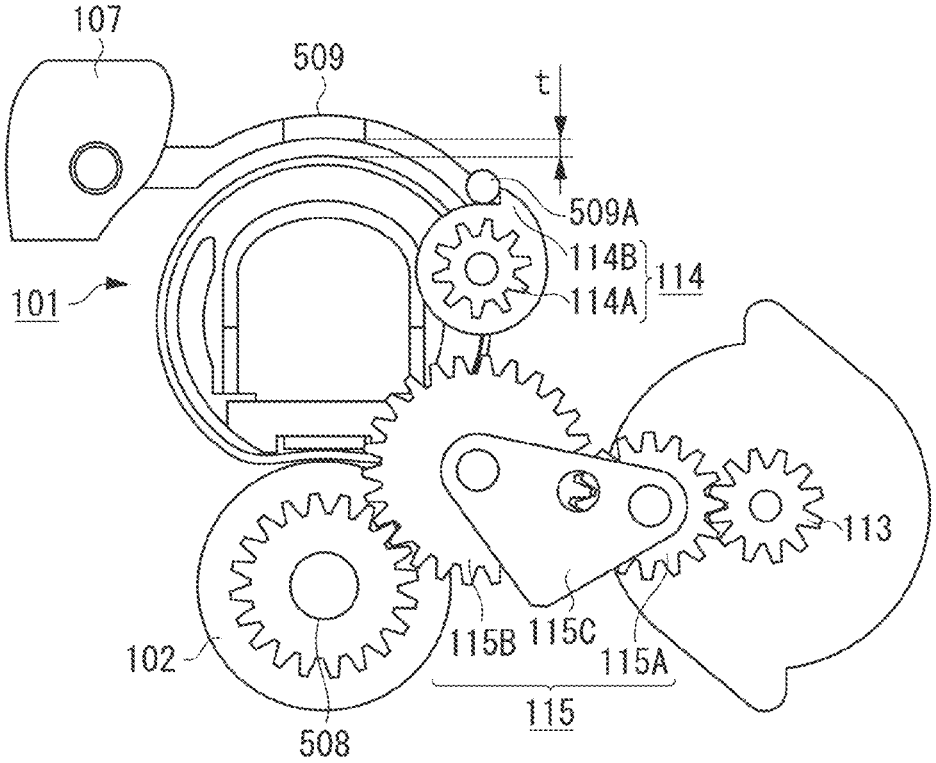
FIG. 21 illustrates an operation of the fixing device according to the seventh exemplary embodiment.
Figure 22:
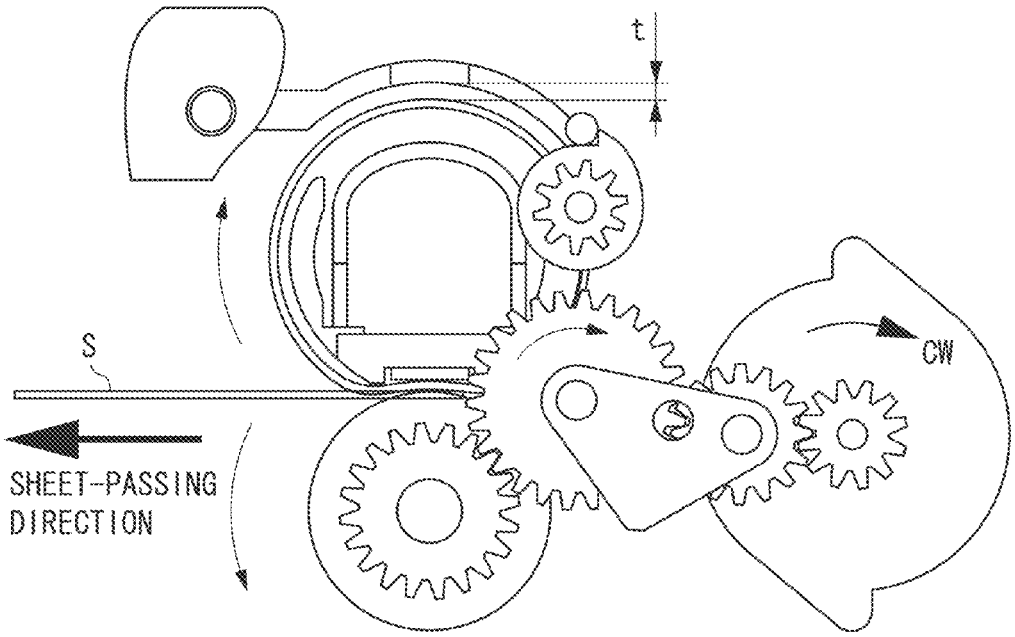
FIG. 22 illustrates an operation of the fixing device according to the seventh exemplary embodiment.
Figure 23A:
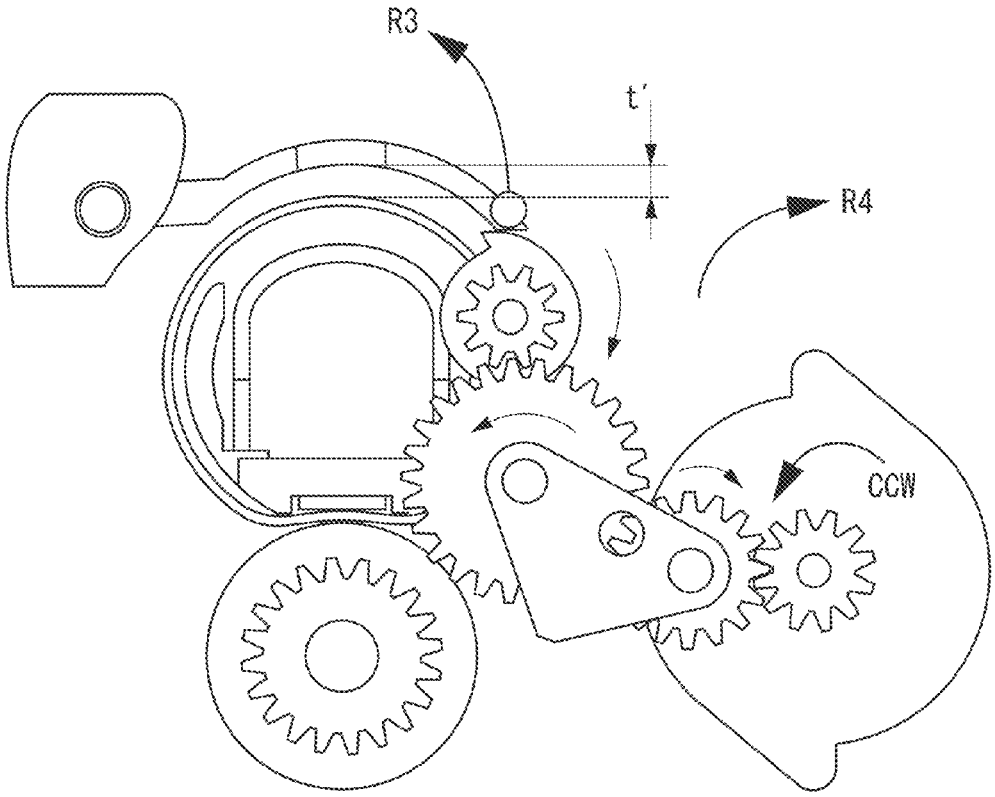
FIGS. 23A and 23B illustrate operations of the fixing device according to the seventh exemplary embodiment.
Figure 23B:
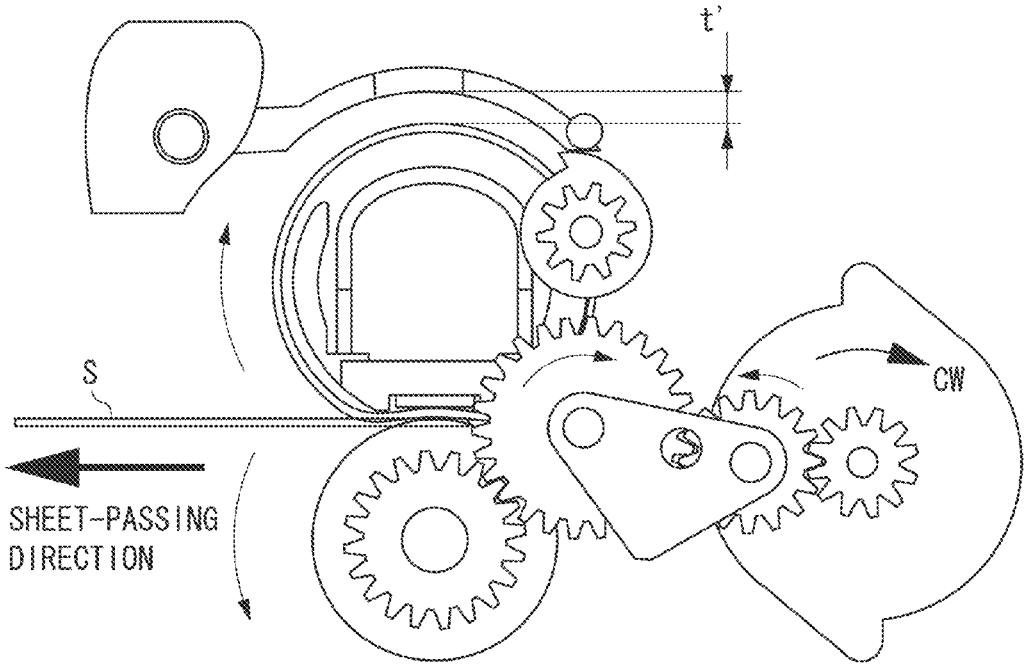
Figure 24A:
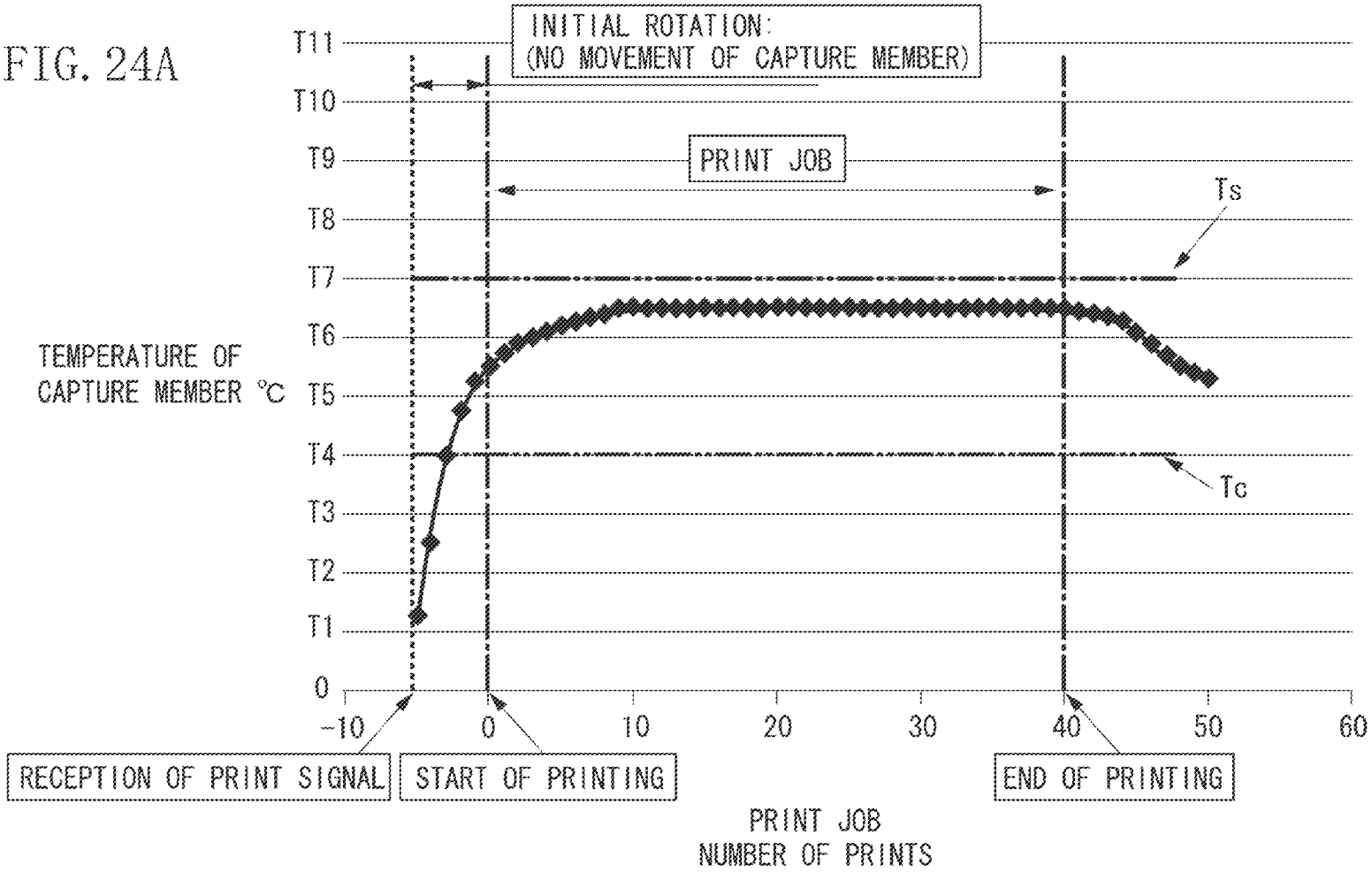
FIGS. 24A and 24B illustrate changes of the temperature of a capture member of the fixing device according to the seventh exemplary embodiment.
Figure 24B:
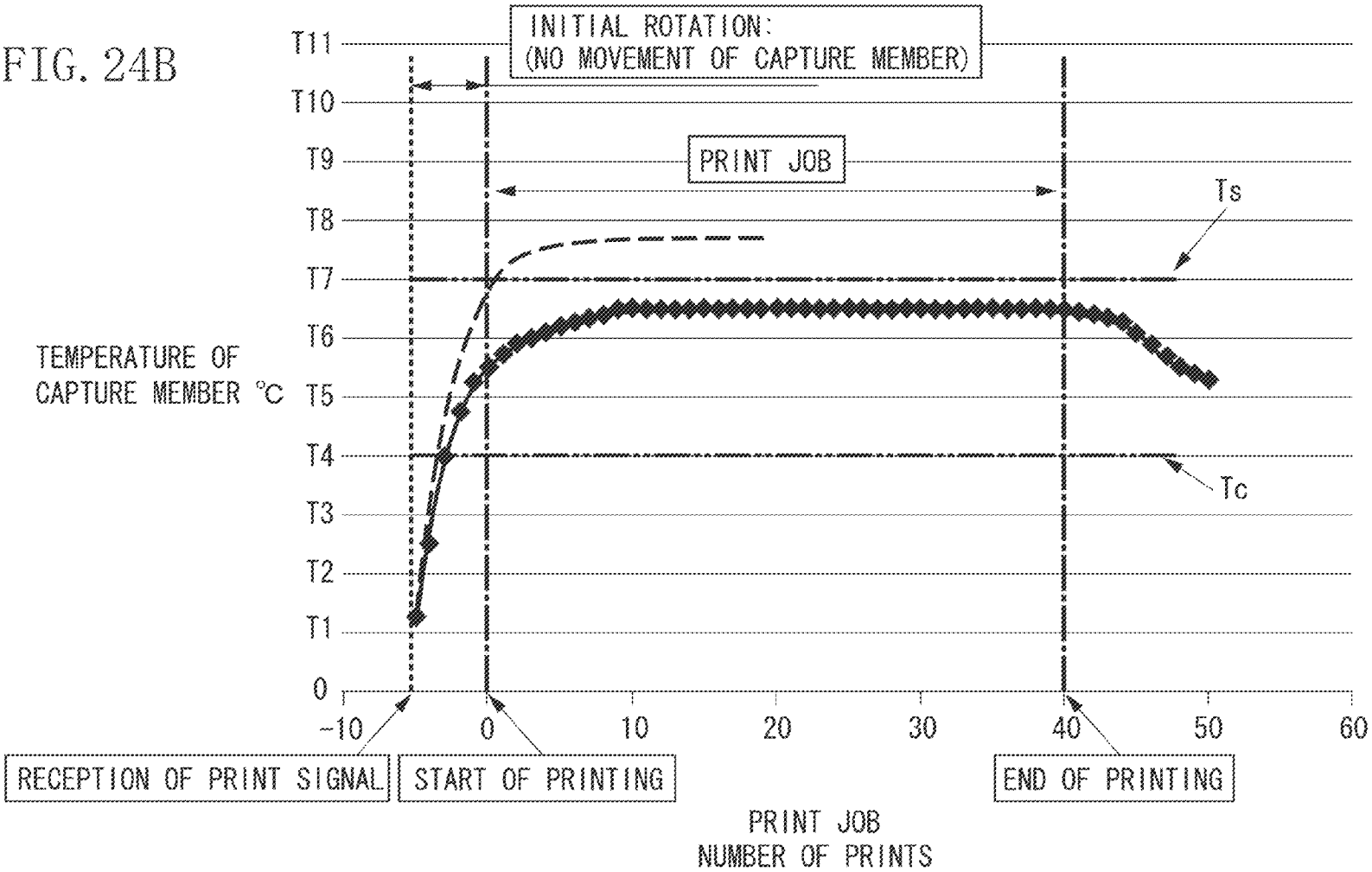

Next, an operation of the capture member 509 and change of the temperature during printing will be described. FIG. 21 illustrates an initial position of the capture member 509 before the CPU 500C receives a print signal. In addition, FIG. 22 illustrates an operation of the capture member 509 in the low temperature mode. FIGS. 23A and 23B illustrate operations of the capture member 509 in the high temperature mode. FIGS. 24A and 24B illustrate changes of the temperature of the capture member 509 during these operations.

First, an operation of the capture member 509 when one-sided printing is performed and the CPU 500C receives a print signal in the low temperature mode will be described. Under this condition, since the heating unit 101 radiates small thermal energy, the capture member 509 is not easily heated. Thus, in the low temperature mode, the capture member 509 is not moved from the initial position illustrated in FIG. 21 from reception of the print signal to the end of the print job. Namely, the distance T from the heating unit 101 is maintained (FIG. 22). Thus, in the low temperature mode, the motor 113 rotates only in the clockwise direction. The clockwise direction is the direction in which a recording material S is conveyed through the fixing nip portion N. The temperature of the capture member 509 changes as indicated by a solid line in FIG. 24A and is maintained within a temperature range between a lower limit temperature Tc and an upper limit temperature Ts in which a vaporized component remains in a liquid state.

Next, an operation of the capture member 509 when the CPU 500C receives a print signal including at least one of the conditions (the high temperature mode and two-sided printing) will be described. In this condition, since the heating unit 101 radiates larger thermal energy than that in one-sided printing and in the low temperature mode, the capture member 509 is heated more easily. Namely, the temperature could rise excessively. A reason why the temperature of the capture member 509 rises more easily in two-sided printing is that the heater 103 radiates heat longer in the two-sided printing than in the one-sided printing. Thus, when the CPU 500C receives a print signal, the CPU 500C starts to rotate the motor 113 in the counterclockwise direction before starting a print operation. Accordingly, the pendulum gear train 115 moves in the direction of an arrow R4 and the pendulum gear 115B engages with the gear portion 114A of the cam 114. As a result, the cam 114 rotates by power from the motor 113, the cam portion 114B raises the abutment portion 509A of the capture member 509, and the position of the capture member 509 is changed from the initial position illustrated in FIG. 22 (rotated in the direction of an arrow R3). In addition, on the basis of a signal from an encoder (not illustrated), the capture member 509 is moved and held at a position so that a distance t' (t'>t) is maintained between the capture member 509 and the heating unit 101 (FIG. 23A). Next, when a print job is started, the motor 113 rotates in the clockwise direction and the pendulum gear train 115 engages with the gear 508 to transmit driving force to the pressure roller 102. As the pressure roller 102 rotates, the recording material S on which a toner image has been printed is conveyed and fixed (FIG. 23B). When the print operation is completed, the motor 113 is rotated in the counterclockwise direction to rotate the cam 114. On the basis of a signal from the encoder (not illustrated), the capture member 509 is returned to and stopped at the initial position in FIG. 21. The temperature of the capture member 509 changes as indicated by a solid line in FIG. 24B. A dotted line in FIG. 24B indicates change of the temperature of the capture member 509 when the capture member 509 is maintained at the distance t in two-sided printing or in the high temperature mode. In such case, the temperature of the capture member 509 exceeds the upper limit temperature Ts, and the capability of capturing the vaporized component is deteriorated.

The conditions for changing the distance between the capture member 509 and the heating unit 101 are not limited to the above information about the print side and the information about the control target temperature of the heater 103. Other conditions may be used. Namely, it is only necessary that the information relating to the temperature of the capture member 509 include at least one of the information about the print side, the information about the fixing mode, and the information about the number of prints. In addition, the target to be captured is not limited to the component vaporized from wax. Examples of the target to be captured include a compound generated from grease that reduces sliding resistance of the fixing film 105. It is only necessary to adjust the distance between the capture member 509 and the heating unit 101 so that the capture member 509 is set to a temperature suitable for capturing the target to be captured.

Figure 25:
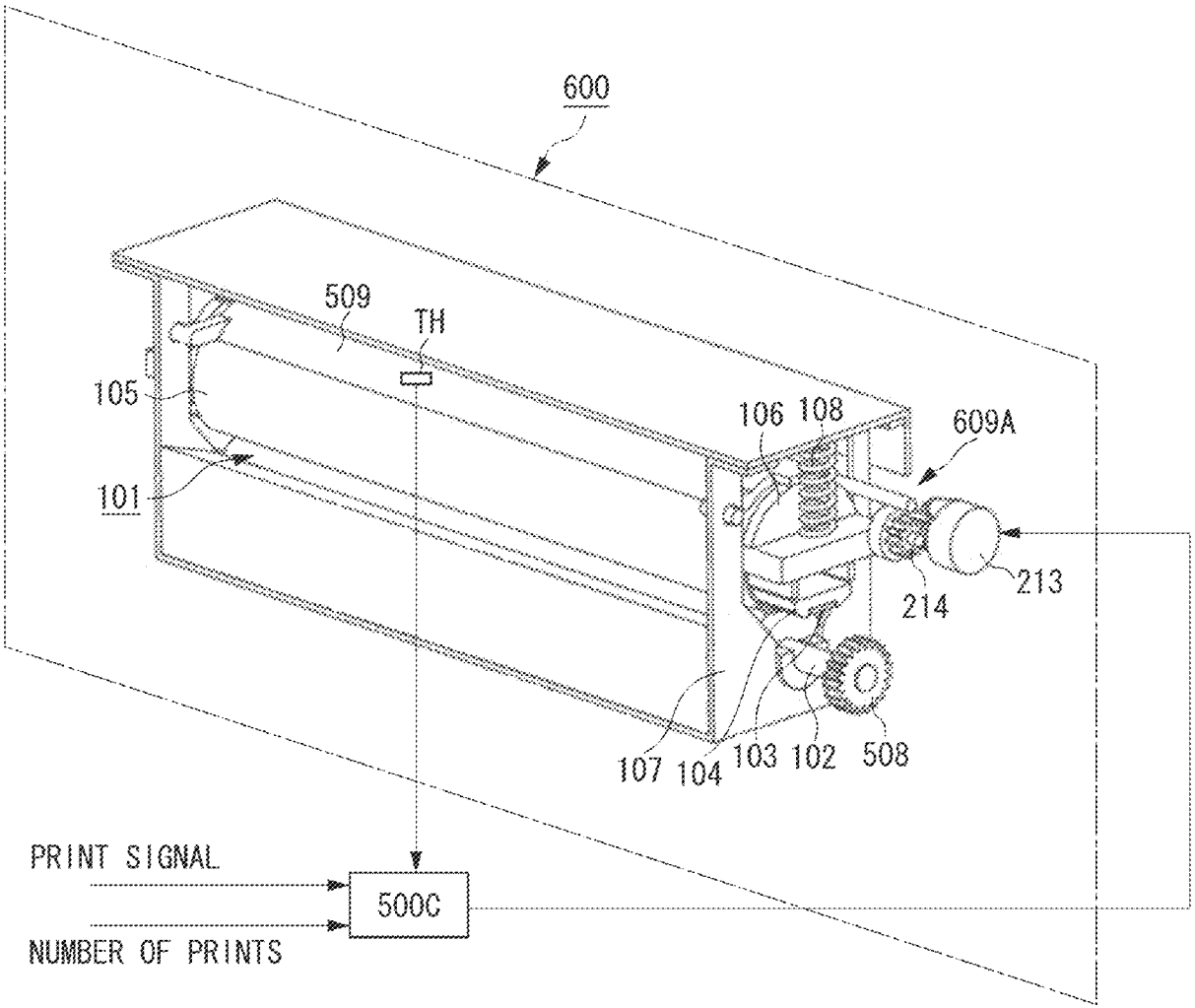
FIG. 25 is a perspective view of a fixing device according to an eighth exemplary embodiment.
Figure 26:
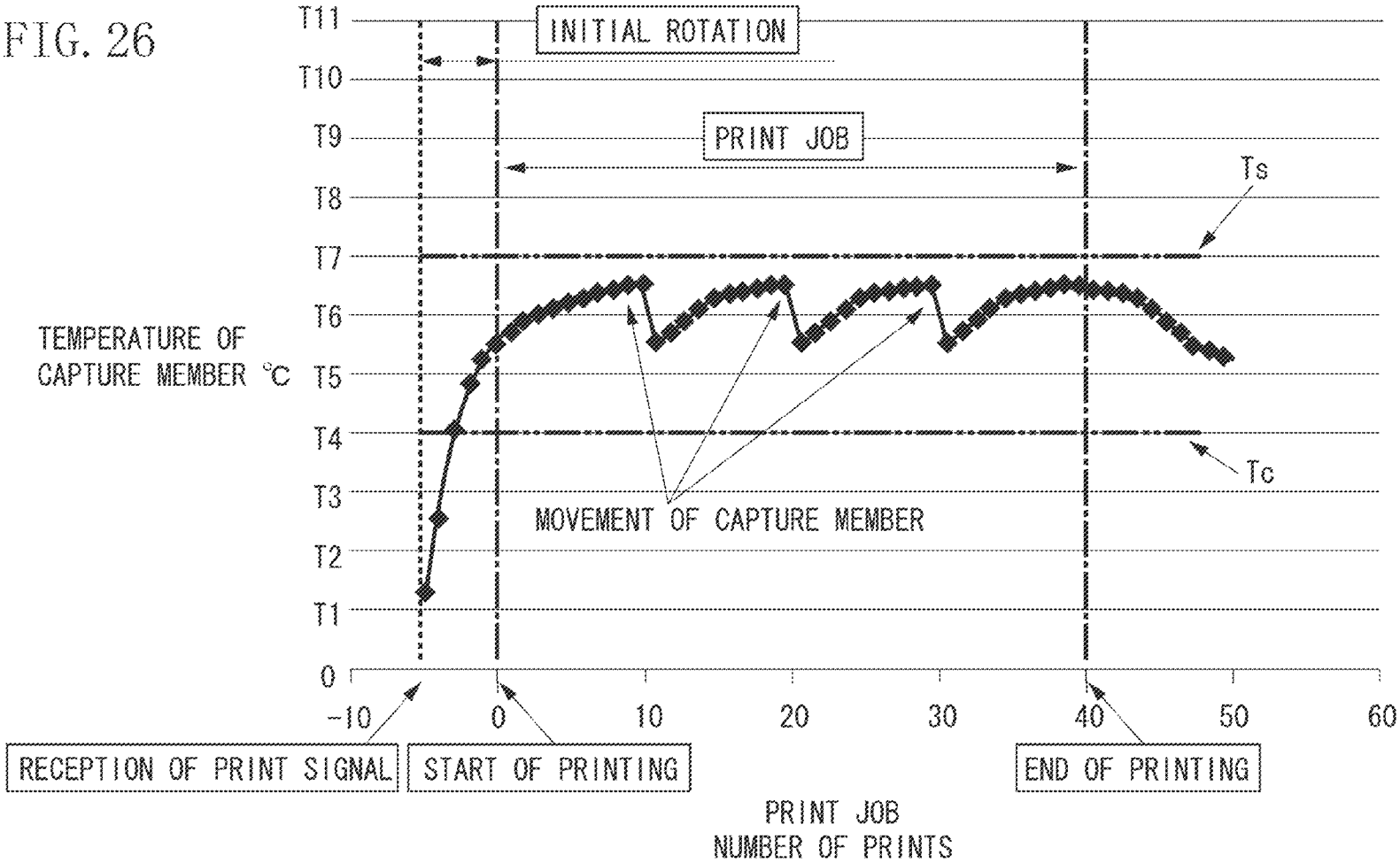
FIG. 26 illustrates changes of the temperature of a capture member of the fixing device according to the eighth exemplary embodiment.
Figure 27:
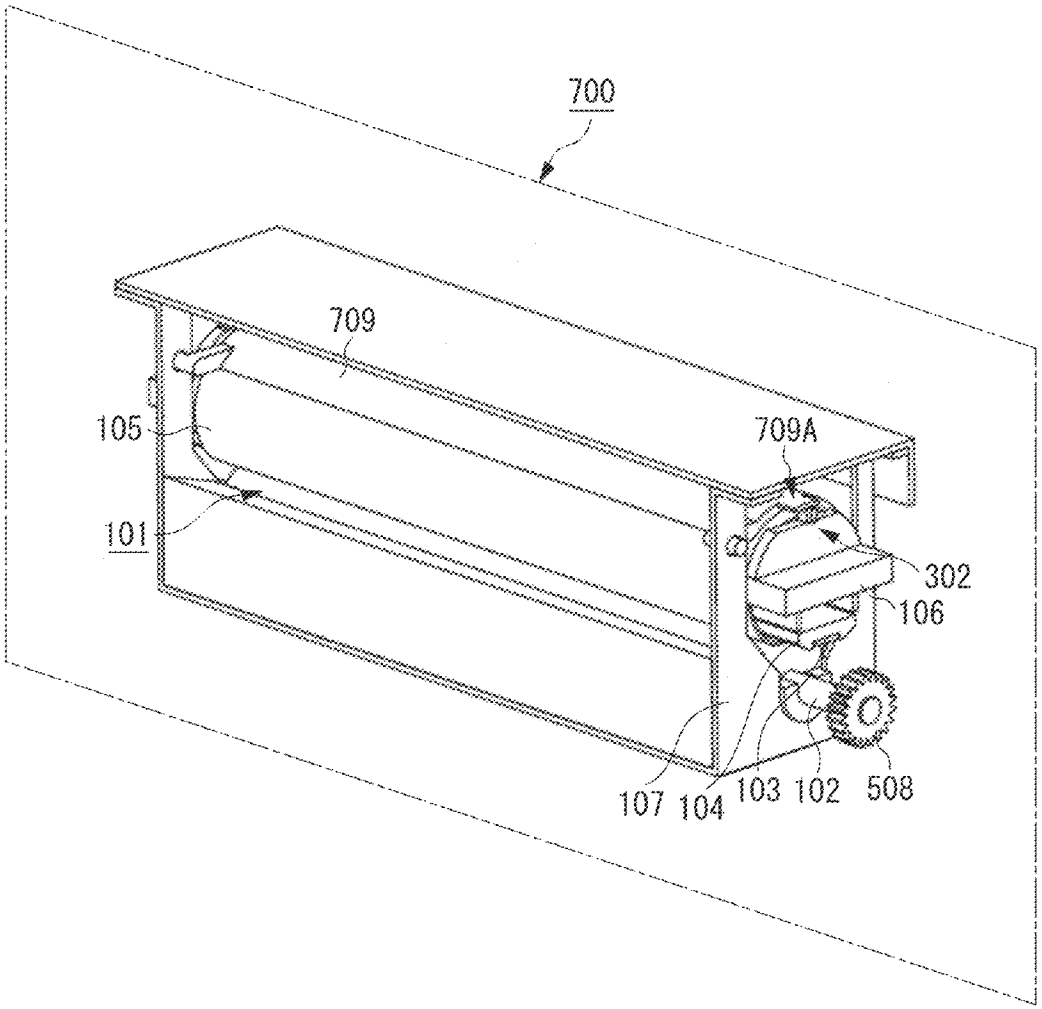
FIG. 27 is a perspective view of a fixing device according to a ninth exemplary embodiment.

An eighth exemplary embodiment will be described with reference to FIGS. 25 to 27. In the present exemplary embodiment, a temperature detection element TH for monitoring the temperature of a capture member 609 is arranged, and the capture member 609 is moved on the basis of the temperature detected by the temperature detection element TH. Namely, in the present exemplary embodiment, the temperature of the capture member 609 is used as the information relating to the temperature of the capture member 609. During printing, the CPU 500C drives a motor 213 and rotates a cam 214, on the basis of the temperature information from the temperature detection element TH. When the cam 214 is rotated, an abutment portion 609A of the capture member 609 is raised by the cam 214, and the distance between the capture member 609 and the heating unit (fixing film 105) is changed. Through this operation, the capture member 609 is maintained at a temperature achieving a high capture effect. While the motor 113 in the sixth exemplary embodiment is used for driving the pressure roller and moving the capture member, the motor 213 according to the present exemplary embodiment is arranged only for moving the capture member 609.

Next, an operation of the capture member 609 and change of the temperature during printing will be described with reference to FIG. 26. When the CPU 500C receives a print signal, the CPU 500C starts to supply power to the heater 103. Accordingly, the temperature of the capture member 609 is increased. The initial position of the capture member 609 is the position corresponding to the distance t described in the sixth exemplary embodiment.

If the image forming apparatus performs a print job of a plurality of number of prints, the temperature of the capture member 609 is gradually increased. The temperature detection element TH detects the temperature, as needed. The CPU 500C controls the motor 213 based on the temperature detected by the temperature detection element TH so that the temperature of the capture member 609 does not deviate from the temperature range Ts-Tc. If the temperature of the capture member 609 rises, the distance between the capture member 609 and the heating unit 105 is adjusted to be widened to the distance t' (t'>t) as in the sixth exemplary embodiment. Since a fixing device 600 according to the present exemplary embodiment includes a dedicated power source (a motor) for moving the capture member 609, the capture member 609 can be moved during printing. Namely, the temperature of the capture member 609 can easily be managed, which is considered an advantageous effect. In addition, as compared with the sixth exemplary embodiment, in the present exemplary embodiment, there is no need to ensure time for moving the capture member 609, which is considered another advantageous effect.

In the present exemplary embodiment, the temperature of the capture member 609 is directly monitored. However, alternatively, the temperature of the capture member 609 may be monitored at a different position where the temperature of the capture member 609 can be estimated. Alternatively, as illustrated in FIG. 25, the temperature of the capture member 609 may be estimated on the basis of the information about the number of prints, without using the temperature detection element TH.

Figure 28A:
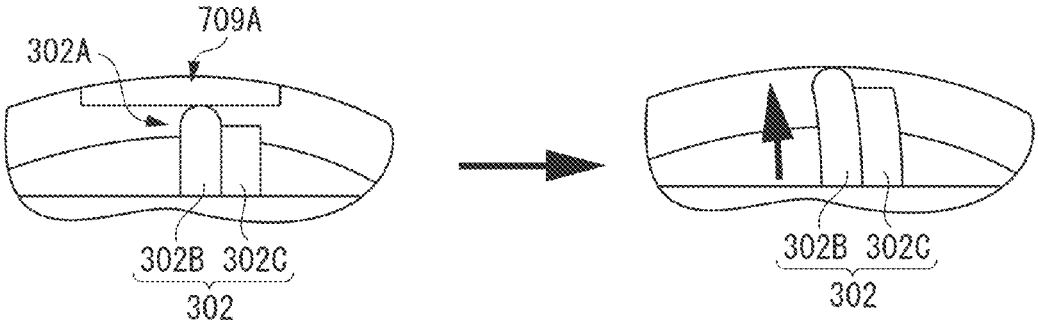
FIGS. 28A and 28B illustrate changes of the shape of an adjustment member of the fixing device according to the ninth exemplary embodiment.
Figure 28B:
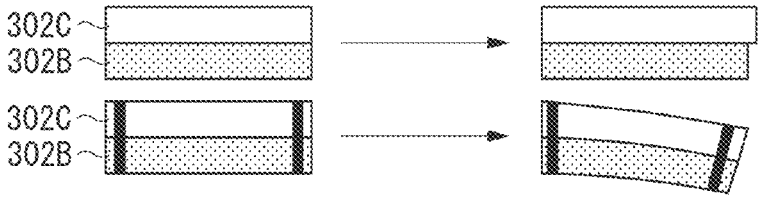

A ninth exemplary embodiment will be described with reference to FIGS. 27 to 30. As illustrated in FIG. 27, a flange 106 arranged at an end of the heating unit 101 is provided with an adjustment member 302 for adjusting the distance between the heating unit 101 and a capture member 709. The adjustment member 302 can be formed by using a bimetal that deforms depending on the temperature. The adjustment member 302 has an abutment portion 302A that abuts on an abutment portion 709A of the capture member 709. If the temperature of the heating unit 101 rises, the abutment portion 302A is stretched as illustrated in FIG. 28A. A bimetal is formed by bonding two types of metals (302B and 302C) having different thermal expansions. By using this property that the two types of metals deform differently by change of the temperature, when the temperature changes, the bimetal changes the shape thereof (see FIG. 28B). FIG. 28B illustrates two bimetals deformed by change of the temperature. The upper bimetal is formed by two metals that are not tied together and the lower bimetal is formed by two metals that are tied by restriction members. In the present exemplary embodiment, a bimetal is used as the adjustment member. However, alternatively, a different material that changes the shape thereof by change of the temperature may be used.

Next, an operation of the capture member 709 and change of the temperature of the capture member 709 during printing will be described with reference to FIGS. 29A and 29B and FIG. 30.

Figure 29A:
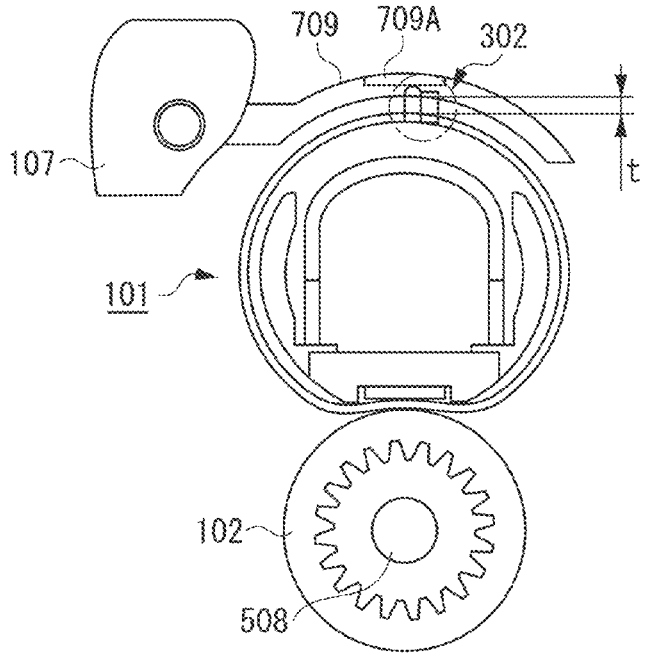
FIGS. 29A and 29B illustrate an operation of the fixing device according to the ninth exemplary embodiment.
Figure 29B:
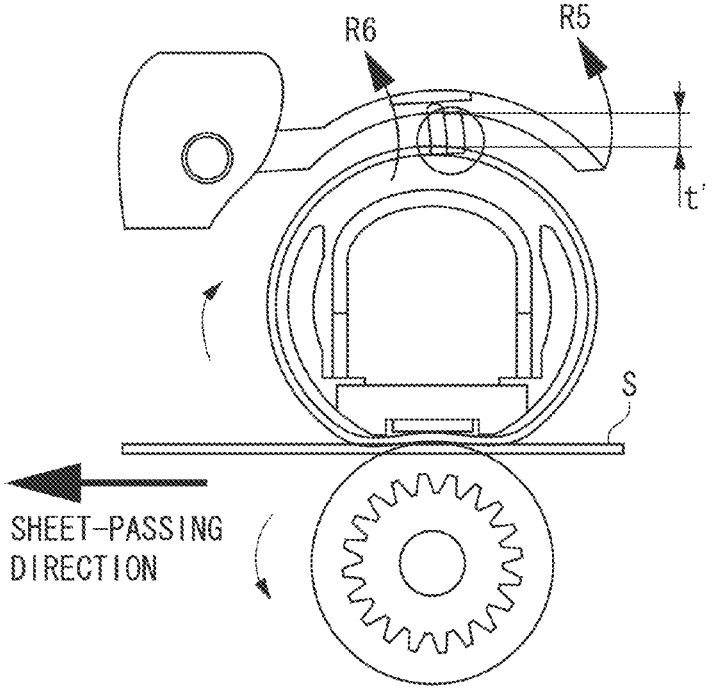
Figure 30:
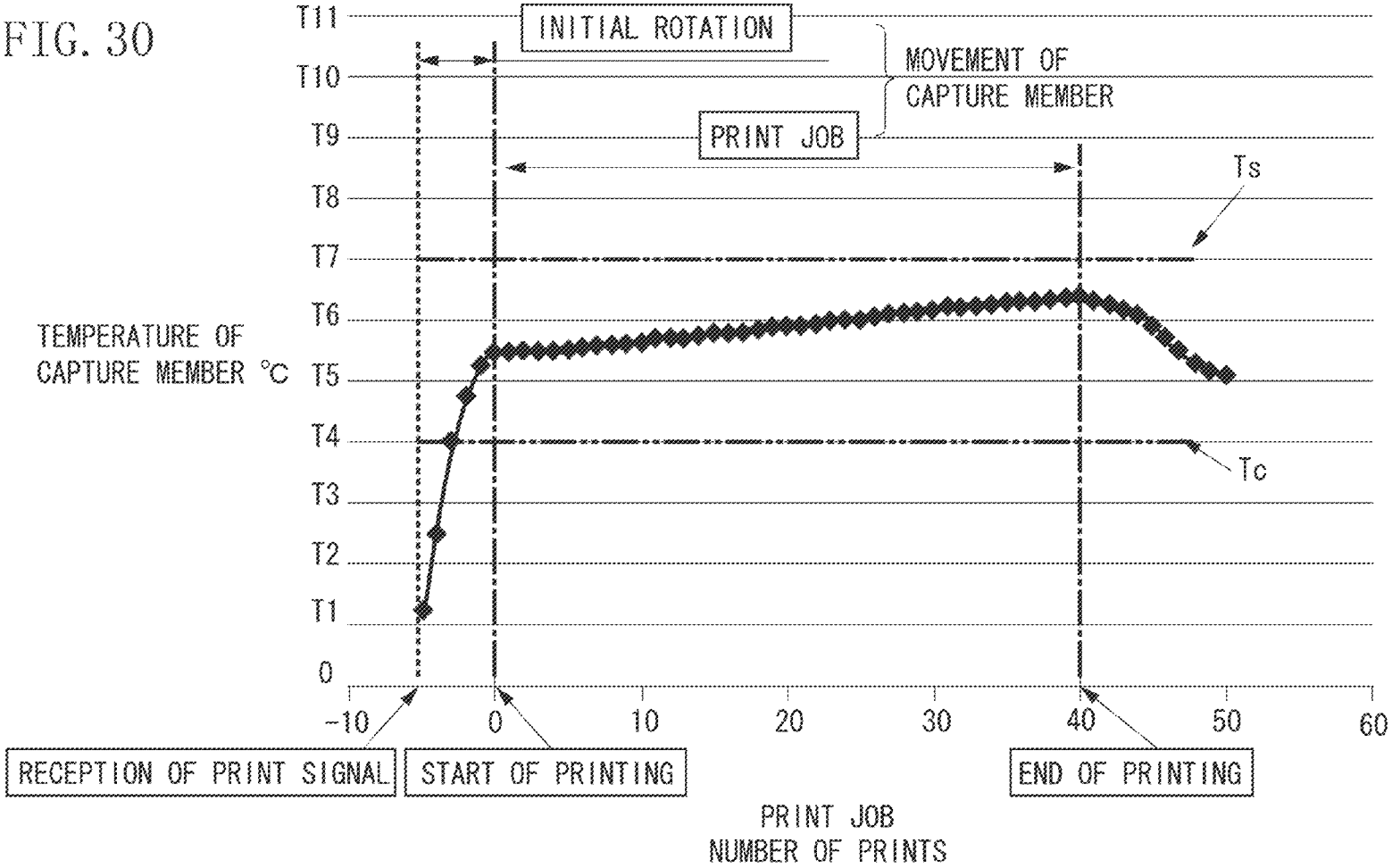
FIG. 30 illustrates changes of the temperature of a capture member of the fixing device according to the ninth exemplary embodiment.

FIGS. 29A and 29B illustrate positions of the capture member 709 before the start of a print operation and when a print job is performed, respectively. FIG. 29A illustrates an initial position of the capture member 709 before reception of a print signal. As the number of prints in a print job increases, the temperature of the heating unit 101 is gradually increased. The adjustment member 302 deforms with this change of the temperature. The capture member 709 moves with the change of the shape of the adjustment member 302. Namely, the position of the capture member 709 is shifted so that the distance between the capture member 709 and the heating unit 101 is increased from the distance t to the distance t' (t'>t) (FIG. 29B). With this configuration, the temperature of the capture member 709 can be maintained within a suitable temperature range Ts-Tc. FIG. 30 is a graph illustrating changes of the temperature of the wax capture member 709 during a print job. As is clear from this graph, with the present configuration, the temperature of the capture member 709 can be maintained at an optimum temperature that is between the lower limit temperature Tc and the upper limit temperature Ts, and the vaporized component can remain in a liquid state within this temperature range. According to the present exemplary embodiment, since no power source for moving the capture member 709 is required, a reduction in space inside the apparatus and a reduction in cost can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-255370 filed Nov. 21, 2012 and No. 2013-234942 filed Nov. 13, 2013, which are hereby incorporated by reference herein in their entirety.

What is claimed is:

1. A fixing device comprising:

a rotatable fixing member configured to heat and fix, onto a recording material, a toner image formed on the recording material;

a pressure member configured to form a nip portion pinching and conveying the recording material with the rotatable fixing member;

a restriction member configured to restrict movement of the rotatable fixing member in a generatrix direction of the rotatable fixing member;

a pressure application mechanism configured to apply pressure to the nip portion via the restriction member;

a pressure release mechanism configured to release the pressure applied to the nip portion, and a capture member configured to capture a component vaporized by heat, wherein the capture member is arranged to face a curved surface portion of the rotatable fixing member and is positioned by the restriction member, and wherein when the pressure release mechanism releases the pressure applied to the nip portion, the restriction member is moved and the capture member is also moved along with the movement of the restriction member.

2. The fixing device according to claim 1, wherein the capture member maintains a temperature at which the vaporized component remains in a liquid state by radiant heat from the rotatable fixing member.

3. The fixing device according to claim 2, wherein the capture member includes a plurality of capture members, which are maintained at respective different temperatures.

4. The fixing device according to claim 3, wherein the plurality of capture members are positioned at respective different distances from the rotatable fixing member.

5. The fixing device according to claim 3, wherein the plurality of capture members are made of respective different materials.

6. The fixing device according to claim 1, wherein the capture member has a surface facing the rotatable fixing member, the surface having a plurality of ribs.

7. The fixing device according to claim 1, wherein the rotatable fixing member is a belt.

8. The fixing device according to claim 7, further comprising a heat source configured to heat the rotatable fixing member, wherein the heat source is in contact with an inner surface of the belt.

9. An image forming apparatus comprising:

a fixing unit configured to heat and fix, onto a recording material, a toner image formed on the recording material, wherein the fixing unit comprises a rotatable fixing member, a pressure member configured to form a nip portion pinching and conveying the recording material with the rotatable fixing member, and a capture member configured to capture a component vaporized by heat;

a face-down tray configured to receive a recording material with a printed image face-down; and a face-up tray configured to appear when a door of the image forming apparatus opens and to receive a recording material with a printed image face-up, wherein the capture member is movable so that a distance between the rotatable fixing member and the capture member changes according to a sheet-passing condition of the recording material, and wherein the sheet-passing condition corresponds to a face-down discharge mode in which a recording material is discharged onto the face-down tray and to a face-up discharge mode in which a recording material is discharged onto the face-up tray.

10. The image forming apparatus according to claim 9, wherein the capture member maintains a temperature at which the vaporized component remains in a liquid state by radiant heat from the rotatable fixing member.

11. The image forming apparatus according to claim 10, wherein the fixing unit further comprises a restriction member configured to restrict movement of the rotatable fixing member in a generatrix direction of the rotatable fixing member, and wherein the capture member is arranged to face a curved surface portion of the rotatable fixing member and is positioned by the restriction member.

12. The image forming apparatus according to claim 9, wherein the capture member is more separated from the rotatable fixing member in the face-up discharge mode than in the face-down discharge mode.

13. The image forming apparatus according to claim 9, wherein the rotatable fixing member is a belt.

14. The image forming apparatus according to claim 13, wherein the fixing unit further comprises a heat source for heating the rotatable fixing member, and the heat source is in contact with an inner surface of the belt.

15. An image forming apparatus comprising:

a fixing unit configured to heat and fix, onto a recording material, a toner image formed on the recording material, wherein the fixing unit comprises a rotatable fixing member, a pressure member configured to form a nip portion pinching and conveying the recording material with the rotatable fixing member, and a capture member configured to capture a component vaporized by heat, wherein the capture member is movable so that a distance between the rotatable fixing member and the capture member changes according to a sheet-passing condition of the recording material, and wherein the sheet-passing condition corresponds to a first-side print operation and a second-side print operation in two-sided printing.

16. The image forming apparatus according to claim 15, wherein the capture member is more separated from the rotatable fixing member in the second side print operation than in the first side print operation.

17. A fixing device comprising:

a rotatable fixing member configured to heat and fix, onto a recording material, a toner image formed on the recording material;

a pressure member configured to form a nip portion pinching and conveying the recording material with the rotatable fixing member;

a capture member configured to capture a component vaporized by heat; and an adjustment member whose shape changes according to the temperature, wherein the capture member moves according to a change of the shape of the adjustment member.

18. The fixing device according to claim 17, wherein the capture member maintains a temperature at which the vaporized component remains in a liquid state by radiant heat from the rotatable fixing member.

19. The fixing device according to claim 18, further comprising a restriction member configured to restrict movement of the rotatable fixing member in a generatrix direction of the rotatable fixing member, wherein the capture member is arranged to face a curved surface portion of the rotatable fixing member and is moved so that a distance from the rotatable fixing member changes.

20. The fixing device according to claim 17, wherein the rotatable fixing member is a belt.

21. The fixing device according to claim 20, further comprising a heat source configured to heat the rotatable fixing member, wherein the heat source is in contact with an inner surface of the belt.

* * * * *